US011248351B1

(12) United States Patent
Johnson et al.

(10) Patent No.: US 11,248,351 B1
(45) Date of Patent: Feb. 15, 2022

(54) DEPLOYABLE EXPEDIENT TRAFFIC ENTRY REGULATOR

(71) Applicant: United States of America as Represented by The Secretary of The Army, Alexandria, VA (US)

(72) Inventors: August N Johnson, Raymond, MS (US); Bowen G Woodson, Clinton, MS (US); Austin C Hopkins, Vicksburg, MS (US)

(73) Assignee: UNITED STATES of AMERICA AS REPRESENTED BY THE SECRETARY OF THE ARMY, Alexandria, VA (US)

( * ) Notice: Subject to any disclaimer, the term of this patent is extended or adjusted under 35 U.S.C. 154(b) by 0 days.

(21) Appl. No.: 16/990,692

(22) Filed: Aug. 11, 2020

(51) Int. Cl.
*E01F 13/02* (2006.01)
*E01F 13/12* (2006.01)
*E01F 13/04* (2006.01)

(52) U.S. Cl.
CPC ..... *E01F 13/123* (2013.01); *E01F 13/02* (2013.01); *E01F 13/048* (2013.01)

(58) Field of Classification Search
CPC ..... E01F 13/02; E01F 13/048; E01F 13/06; E01F 13/10; E01F 13/12; E01F 13/123
See application file for complete search history.

(56) References Cited

U.S. PATENT DOCUMENTS

| | | | | |
|---|---|---|---|---|
| 4,531,472 | A * | 7/1985 | Marrero | E01F 13/048 116/28 R |
| 7,690,321 | B2 * | 4/2010 | Karow | E01F 13/02 116/63 P |
| 7,850,392 | B2 * | 12/2010 | Schubert | E01F 13/12 404/6 |
| 8,128,310 | B2 * | 3/2012 | Dindl | E01F 13/12 404/6 |
| 8,523,479 | B2 * | 9/2013 | Adler | E01F 13/12 404/6 |
| 9,394,657 | B2 * | 7/2016 | Groeneweg | E01F 9/662 |
| 9,863,105 | B1 * | 1/2018 | Price | E01F 13/12 |
| 9,982,403 | B2 * | 5/2018 | Price | E01F 13/02 |
| 10,024,008 | B2 * | 7/2018 | Holmer | E01F 15/00 |
| 10,570,577 | B2 * | 2/2020 | Kramer | E01F 13/048 |
| 10,724,192 | B2 * | 7/2020 | Rothschild | E01F 13/12 |
| 10,837,149 | B2 * | 11/2020 | Klein | E01F 13/08 |

(Continued)

*Primary Examiner* — Gary S Hartmann
(74) *Attorney, Agent, or Firm* — Brian C. Jones

(57) ABSTRACT

In one embodiment, a deployable barrier container apparatus includes: in folded position, a container and, in unfolded position, a vertical barrier component is deployable on a base placed on the ground to oppose vehicle traffic approaching from an upstream side. A second side wall and a ceiling top are disposed on the downstream side of the base. A first side wall and a stowed top are disposed on the upstream side of the base and on which approaching vehicles move. The horizontal barrier component is disposed upstream of the stowed top and on which the approaching vehicles move, and the horizontal barrier component comprises an elongated sliding friction mat which creates a sliding friction interface with the ground upon contact of a moving vehicle with the deployed vertical barrier component in the deployed position. The base, side walls, and tops are rotatably connected to unfold to form the barrier apparatus.

20 Claims, 25 Drawing Sheets

(56) References Cited

U.S. PATENT DOCUMENTS

| | | | | |
|---|---|---|---|---|
| 10,920,485 | B2 * | 2/2021 | Zwierzykowski | E06B 9/00 |
| 10,947,682 | B2 * | 3/2021 | Foster | E01F 15/065 |
| 2012/0177439 | A1 * | 7/2012 | More | E01F 13/12 404/6 |
| 2014/0259930 | A1 * | 9/2014 | Gilliam | E06B 11/026 49/70 |
| 2014/0301781 | A1 * | 10/2014 | Lindberg | E01F 15/146 404/6 |
| 2016/0343251 | A1 * | 11/2016 | Lee | G08G 1/04 |
| 2019/0106850 | A1 * | 4/2019 | Fiordi | A01G 9/02 |
| 2020/0141075 | A1 * | 5/2020 | Kramer | E01F 13/08 |
| 2020/0318384 | A1 * | 10/2020 | Samara | F41H 11/10 |
| 2020/0339352 | A1 * | 10/2020 | Kane | E01F 13/02 |
| 2021/0062443 | A1 * | 3/2021 | Novak | E01F 13/12 |

* cited by examiner

DEPLOYABLE EXPEDIENT TRAFFIC ENTRY REGULATOR

STATEMENT OF GOVERNMENT INTEREST

Under paragraph 1(a) of Executive Order 10096, the conditions under which this invention was made entitle the Government of the United States, as represented by the Secretary of the Army, to an undivided interest therein on any patent granted thereon by the United States. This and related patents are available for licensing to qualified licensees.

BACKGROUND

Field of the Invention

The present invention relates to rapidly deployable traffic barriers (referred to as "expedient barriers") which bring vehicles to a controlled stop by interfering with tire rolling.

Description of the Related Art

This section introduces aspects that may help facilitate a better understanding of the invention. Accordingly, the statements of this section are to be read in this light and are not to be understood as admissions about what is prior art or what is not prior art.

Vehicle checkpoints, roadblocks, and barriers (i.e., "barriers" generally) manned by military personnel and/or law enforcement are becoming increasingly commonplace in the world we live in. There are several objectives of the barriers. To the greatest extent possible, the personnel who are operating the barriers must be protected from threats, typically associated with the vehicles and occupants the barriers are designed to stop. Of course, barriers usually serve to protect personnel and facilities within an established perimeter or region.

Often, in a crisis, expedient barriers must be rapidly deployed. As a result, vehicles containing peaceful civilians or other local police or military personnel may unexpectedly encounter an expedient barrier where none previously existed, be caught by surprise, and fail to appropriately slow down.

U.S. Pat. No. 10,024,008 discloses a vehicle barrier apparatus which includes a horizontal barrier component, a vertical barrier component, at least one rigid stabilizer beam having two end surfaces and at least one elongated side surface. One end of the stabilizer beam is affixed to the vertical barrier component. The elongated side surface of the stabilizer beam is affixed to the horizontal barrier component to prevent rotational movement of the vertical barrier component. A lower surface of the horizontal barrier component is a friction-enhanced surface which creates a sliding friction interface upon contact of a moving vehicle with the vertical barrier component. This patent is incorporated herein by reference in its entirety.

SUMMARY

Hostile vehicle mitigation (HVM) continues to be of critical importance around the world, especially in urban environments. Many conventional solutions are too slow to deploy, require significant construction efforts, are not modular enough for limited duration requirements, or do not offer adequate protection against larger vehicle threats.

The present invention was developed to address the need for a robust, versatile, and adaptable approach to hostile vehicle mitigation. Research and development have led to a novel deployable expedient traffic entry regulator (DETER) based on packaging and integration of a pre-kitted wedge barrier into QuadCon size ISO container footprint. An active barrier wedge is integrated into a QuadCon base. The regulator can be used to regulate entry to an area or exit from the area. In this discussion, the traffic entry regulator is used to regulate entry of approaching traffic toward the traffic entry regulator from an entry side, with the traffic entry regulator as the point of reference. As such, it can be used to regulate entry into or exit from an area.

In one example, the QuadCon has a floor or base structure assembly, two top panels (a ceiling top panel and an extra, stowed top panel), and two side panels or side wall subassemblies which are connected via hinged connections. There are two removable end walls or panels or tarp covers, at least one of which may optionally be configured as one or two doors. In the QuadCon's closed or folded position prior to unfolding, the barrier is contained inside the QuadCon and disposed on its base structure assembly. To unfold the traffic entry regulator, the two end panels are removed and the two side walls and two top panels (ceiling top and stowed top) converted from the closed position to an open or unfolded position. In the open position, the traffic entry regulator is in a passive mode before the vertical entry barrier is erected and in an active mode after the vertical entry barrier is erected from the base, which is elevated above the ground. The two side walls and the top panels of the QuadCon are converted into ramps and toe ramps for the vertical entry/exit barrier and deployed on the ground. The side walls forming the ramps and the top panels forming the toe ramps have fiberglass grate decking on the interior sides that becomes the top sides of the ramps and toe ramps. For example, the grate decking is made of SPF polyester resin having 1.5" height×0.6" top flange width I-bar with medium grit surface and 60% open area.

On the entrance side of the vertical entry barrier is a sliding friction matting system. In specific embodiments, the ACEMAT sliding friction matting is provided in an accordion configuration that is unfolded and stretched out on the entrance/approach side upstream of the traffic entry regulator. In one example, the ACEMAT has three integrated continuous 4" straps linking six 4'×8' matting panels or mat sections folded in the accordion manner. The ACEMAT matting design is optimized based on ERDC's historical designs.

Each QuadCon is deployed to form a deployable expedient traffic entry regulator (DETER) unit. Multiple units can be joined in a modular manner using standard QuadCon corner castings to accommodate configurations of variable widths. For example, two traffic entry regulator units are deployed having a combined width of over 16' to accommodate a representative Class 6 truck track width maximum standard spacing of 102" per Federal size regulations for commercial motor vehicles. See https://ops.fhwa.dot.gov/freight/publications/size_regs_final_rpt/.

Deployment of the traffic entry regulator requires limited tools and equipment and no anchoring. The traffic entry regulator is of modular assembly. It is recoverable and reusable.

The result is an expedient, kitted non-anchored active vehicle barrier solution that is deployable in minutes with modular connectivity between units and is applicable for use in urban environments and provides hostile vehicle mitigation (HVM) capability against box trucks and other larger class vehicles. The traffic entry regulator possesses HVM capability focused on, but not limited to, operations in the urban environment, offering enhanced protection combined with the agility of a rapidly deployable system.

In accordance with an aspect of the present invention, a deployable barrier container apparatus comprises: in a folded position, a base, a first side wall having a first proximal edge and a first distal edge, a second side wall having a second proximal edge and a second distal edge, the first proximal edge and the second proximal edge rotatably connected to the base on opposite sides of the base, a ceiling top having a distal ceiling top edge and a proximal ceiling top edge which is rotatably connected to the second distal edge of the second side wall, and a stowed top which is stowed inside in the folded position, the stowed top having a proximal stowed top edge rotatably connected to the first distal edge of the first side wall and having a distal stowed top edge, the base, first and second side walls, and the ceiling top forming a rectangular shape as a container in the folded position; a vertical barrier component connected to the base and disposed inside the container in the folded position of the container; and a horizontal barrier component rotatably connected with the distal stowed top edge of the stowed top and disposed inside the container in the folded position of the container. In an unfolded position of the container, the vertical barrier component is deployable on the base placed on a ground to oppose vehicle traffic approaching from an upstream side, the second side wall and the ceiling top are disposed on the downstream side of the base, the first side wall and the stowed top are disposed on the upstream side of the base and on which approaching vehicles move, the horizontal barrier component is disposed upstream of the stowed top and on which the approaching vehicles move, and the horizontal barrier component comprises an elongated sliding friction mat which creates a sliding friction interface with the ground upon contact of a moving vehicle with the deployed vertical barrier component in the deployed position.

In some embodiments, a pair of top corner crossbars which, in the folded position of the container, are disposed on opposite sides of the ceiling top between the first side wall and the second side wall, releasably connecting opposite top corners of the first side wall and the second side wall.

In specific embodiments, in the unfolded position of the container, the base is elevated above the ground, the second side wall on the upstream side forming an up-ramp to the base, the first side wall on the downstream side forming a down-ramp from the base.

In some embodiments, the first side wall includes a plurality of spaced-apart longitudinal beams oriented parallel to a direction of vehicle traffic interconnected by a plurality of spaced-apart lateral beams to provide pockets to receive grate decking units disposed on an upper side of the down-ramp, in the unfolded position of the container, on which the approaching vehicles move; and the second side wall includes a plurality of spaced-apart longitudinal beams oriented parallel to the direction of vehicle traffic interconnected by a plurality of spaced-apart lateral beams to provide pockets to receive grate decking units disposed on an upper side of the up-ramp, in the unfolded position of the container, on which the approaching vehicles move.

In specific embodiments, the stowed top decreases in thickness from the proximal stowed top edge to the distal stowed top edge to form a down-toe-ramp, the stowed top including a plurality of spaced-apart longitudinal beams oriented parallel to the direction of vehicle traffic interconnected by a plurality of spaced-apart lateral beams to provide pockets to receive grate decking units disposed on an upper side of the down-toe-ramp, in the unfolded position of the container, on which the approaching vehicles move; and the ceiling top decreases in thickness from the proximal ceiling top edge to the distal ceiling top edge to form an up-toe-ramp, the ceiling top including a plurality of spaced-apart longitudinal beams oriented parallel to the direction of vehicle traffic interconnected by a plurality of spaced-apart lateral beams to provide pockets to receive grate decking units disposed on an upper side of the up-toe-ramp, in the unfolded position of the container, on which the approaching vehicles move.

In some embodiments, the sliding friction mat of the horizontal barrier component comprises a plurality of sliding friction mat sections connected in series, the plurality of sliding friction mat sections being collapsed and stored inside the container in the folded position of the container and being extended to form the elongated sliding friction mat on the ground in the unfolded position of the container.

In specific embodiments, the vertical barrier component is movable between an active barrier position and a passive barrier position, the vertical barrier component being housed inside the base in the passive barrier position, the vertical barrier component being deployed above the base in the active barrier position.

In some embodiments, the vertical barrier component comprises a plurality of pivoting bars having proximal ends connected to the base to pivot around a first pivot line, a plurality of pivoting supports having proximal ends connected to the base to pivot around a second pivot line disposed upstream of the first pivot line, and one or more slide bars each transversely coupled to at least two of the pivoting bars to slide along the pivoting bars between the proximal ends and distal ends of the pivoting bars, the one or more slide bars being connected to distal ends of the pivoting supports to pivot around the second pivot line, the distal ends of the pivoting bars pointing at an angle upward in the upstream direction against approaching vehicles in the active barrier position.

In specific embodiments, four base corner members are disposed at four corners of the base under the corresponding first side wall or corresponding second side wall, each base corner member includes a hollow base corner block having an elongated side opening facing outwardly in a direction parallel to the bottom edges of the side walls. A pair of connection tools are used to modularly connect two bases of two deployable barrier container apparatuses side-by-side by connecting two hollow base corner blocks of a first base of a first deployable barrier container apparatus and two hollow base corner blocks of a second base of a second deployable barrier container apparatus, each connection tool including a pair of oppositely facing elongated connection disks oriented in an axial direction along a connection tool axis that is parallel to the bottom edges of the side walls, the elongated connection disks being shaped and sized to fit through the elongated side openings of the hollow base corner blocks into the hollow base corner blocks and each being extended outwardly via a narrow region which allows the connection tool to rotate with a connection tool handle from a generally vertical position to a generally horizontal position to engage and lock the elongated connection disks against the elongated side openings in the generally horizontal position of the connection tool.

In accordance with another aspect of the invention, a deployable barrier container apparatus comprises: in a folded position, a base, a first side wall having a first proximal edge and a first distal edge, a second side wall having a second proximal edge and a second distal edge, the first proximal edge and the second proximal edge rotatably connected to the base on opposite sides of the base, a ceiling top having a distal ceiling top edge and a proximal ceiling top edge which is rotatably connected to the second distal edge of the second side wall, and a stowed top which is stowed inside in the folded position, the stowed top having a proximal stowed top edge rotatably connected to the first distal edge of the first side wall and having a distal stowed top edge, the base, first and second side walls, and the ceiling top forming a rectangular shape as a container in the folded position; a vertical barrier component connected to the base and disposed inside the container in the folded position of the container, the vertical barrier component being deployable on the base placed on a ground to oppose vehicle traffic approaching from an upstream side; and a sliding friction mechanism for creating a sliding friction interface with the ground upon contact of an approaching vehicle with the deployed vertical barrier component, to prevent contact between the approaching vehicle and the ground, the sliding friction mechanism being connected with the first side wall and disposed inside the container in the folded position of the container. In an unfolded position of the container, the second side wall and the ceiling top are disposed on the downstream side of the base, the first side wall and the stowed top are disposed on the upstream side of the base and on which approaching vehicles move, and the sliding friction mechanism is disposed upstream of the stowed top and on which the approaching vehicles move.

In some embodiments, the first side wall includes a plurality of spaced-apart beams and a first load-distributing mechanism for distributing load over the spaced-apart beams, the first load-distributing mechanism being disposed, in the unfolded position of the container, on which the approaching vehicles move. The second side wall includes a plurality of spaced-apart beams and a second load-distributing mechanism for distributing load over the spaced-apart beams, the second load-distributing mechanism being disposed, in the unfolded position of the container, on which the approaching vehicles move.

In specific embodiments, the stowed top decreases in thickness from the proximal stowed top edge to the distal stowed top edge to form a down-toe-ramp, the stowed top including a plurality of spaced-apart beams and a third load-distributing mechanism for distributing load over the spaced-apart beams, the third load-distributing mechanism being disposed, in the unfolded position of the container, on which the approaching vehicles move. The ceiling top decreases in thickness from the proximal ceiling top edge to the distal ceiling top edge to form an up-toe-ramp, the ceiling top including a plurality of spaced-apart beams and a fourth load-distributing mechanism for distributing load over the spaced-apart beams, the fourth load-distributing mechanism being disposed, in the unfolded position of the container, on which the approaching vehicles move.

In some embodiments, the vertical barrier component comprises a plurality of pivoting bars having proximal ends connected to the base to pivot around a first pivot line and distal ends pointing at an angle upward in the upstream direction against approaching vehicles in an active barrier position; and a mechanism for collapsing the pivoting bars to be housed inside the base in a passive barrier position and deploying the pivoting bars to be supported at the angle upward in the upstream direction against approaching vehicles in the active barrier position.

In specific embodiments, the apparatus includes a mechanism for detachably connecting adjacent containers that are placed side-by-side and, in the unfolded position of the containers, provide adjacent side-by-side vertical barriers against approaching vehicles.

In accordance with yet another aspect of this invention, a deployable barrier container apparatus comprises: in a folded position, a base, a first side wall having a first proximal edge and a first distal edge, a second side wall having a second proximal edge and a second distal edge, the first proximal edge and the second proximal edge rotatably connected to the base on opposite sides of the base, a ceiling top having a distal ceiling top edge and a proximal ceiling top edge which is rotatably connected to the second distal edge of the second side wall, and a stowed top which is stowed inside in the folded position, the stowed top having a proximal stowed top edge rotatably connected to the first distal edge of the first side wall and having a distal stowed top edge, the base, first and second side walls, and the ceiling top forming a rectangular shape as a container in the folded position; and a vertical barrier component connected to the base and disposed inside the container in the folded position of the container. In an unfolded position of the container, the vertical barrier component is deployable on the base placed on a ground to oppose vehicle traffic approaching from an upstream side, the second side wall and the ceiling top are disposed on the downstream side of the base, the first side wall and the stowed top are disposed on the upstream side of the base and on which approaching vehicles move, the base is elevated above the ground, the second side wall on the upstream side forms an up-ramp to the base, and the first side wall on the downstream side forms a down-ramp from the base.

Hence, embodiments of the present invention encompass techniques that make use of leveraging the degrees of freedom of adaptable position mechanisms to allow the same system to be used at multiple sites with minimal modification. Advantageously, embodiments of the present invention can be used to mitigate potential hostile vehicle progress into a secured area or establish an expedient system to limit and control access by vehicles of a controlled perimeter.

BRIEF DESCRIPTION OF THE DRAWINGS

Embodiments of the invention will become more fully apparent from the following detailed description, the appended claims, and the accompanying drawings in which like reference numerals identify similar or identical elements.

DETAILED DESCRIPTION

Detailed illustrative embodiments of the present invention are disclosed herein. However, specific structural and functional details disclosed herein are merely representative for purposes of describing example embodiments of the present invention. The present invention may be embodied in many alternate forms and should not be construed as limited to only the embodiments set forth herein. Further, the terminology used herein is for the purpose of describing particular embodiments only and is not intended to be limiting of example embodiments of the invention.

As used herein, the singular forms "a," "an," and "the," are intended to include the plural forms as well, unless the context clearly indicates otherwise. It further will be understood that the terms "comprises," "comprising," "includes," and/or "including," specify the presence of stated features, steps, or components, but do not preclude the presence or addition of one or more other features, steps, or components. It also should be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Figure 1:
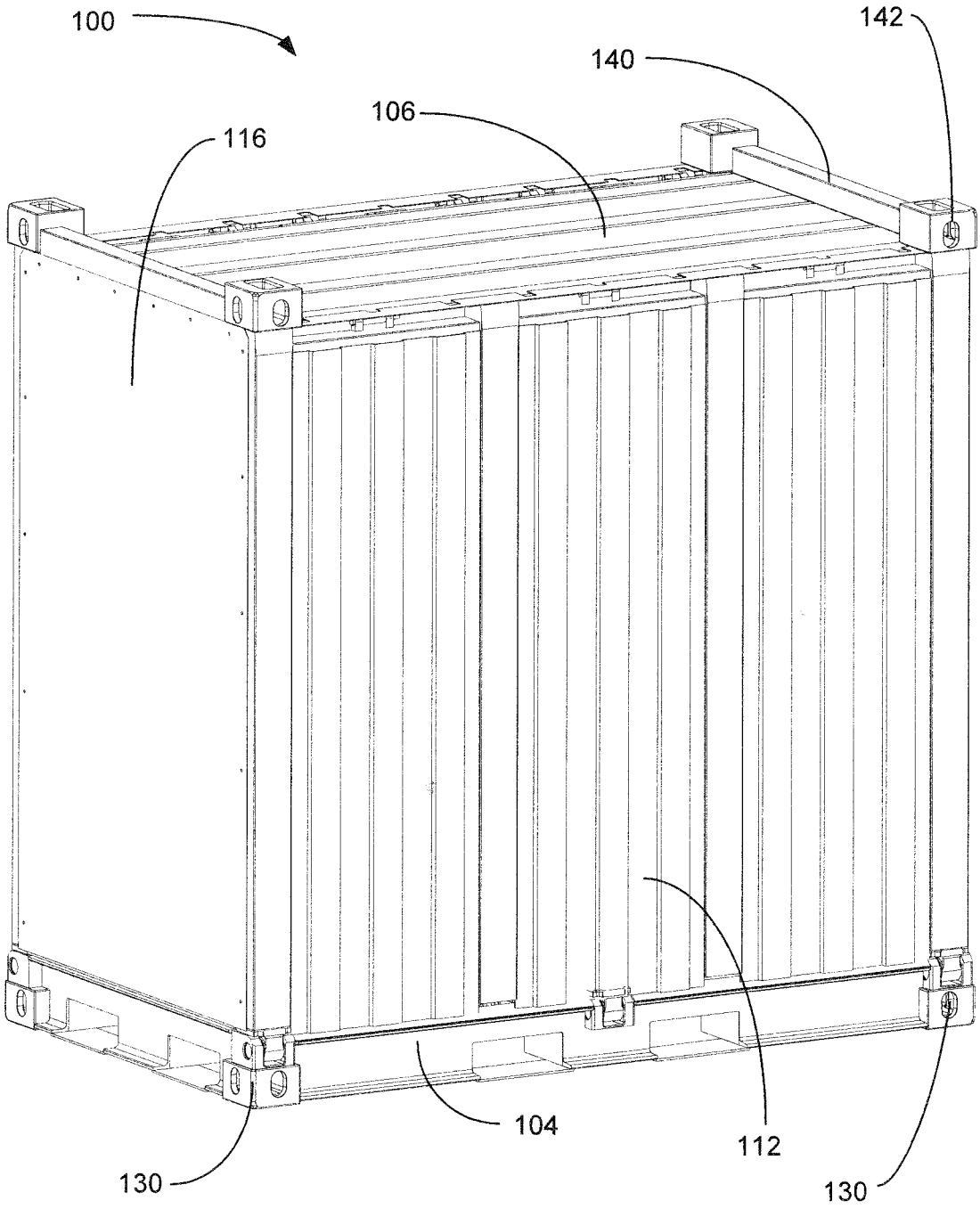
FIG. 1 is a perspective view of a deployable expedient traffic entry regulator (DETER) unit in a folded position according to an embodiment of the present invention.
Figure 2:
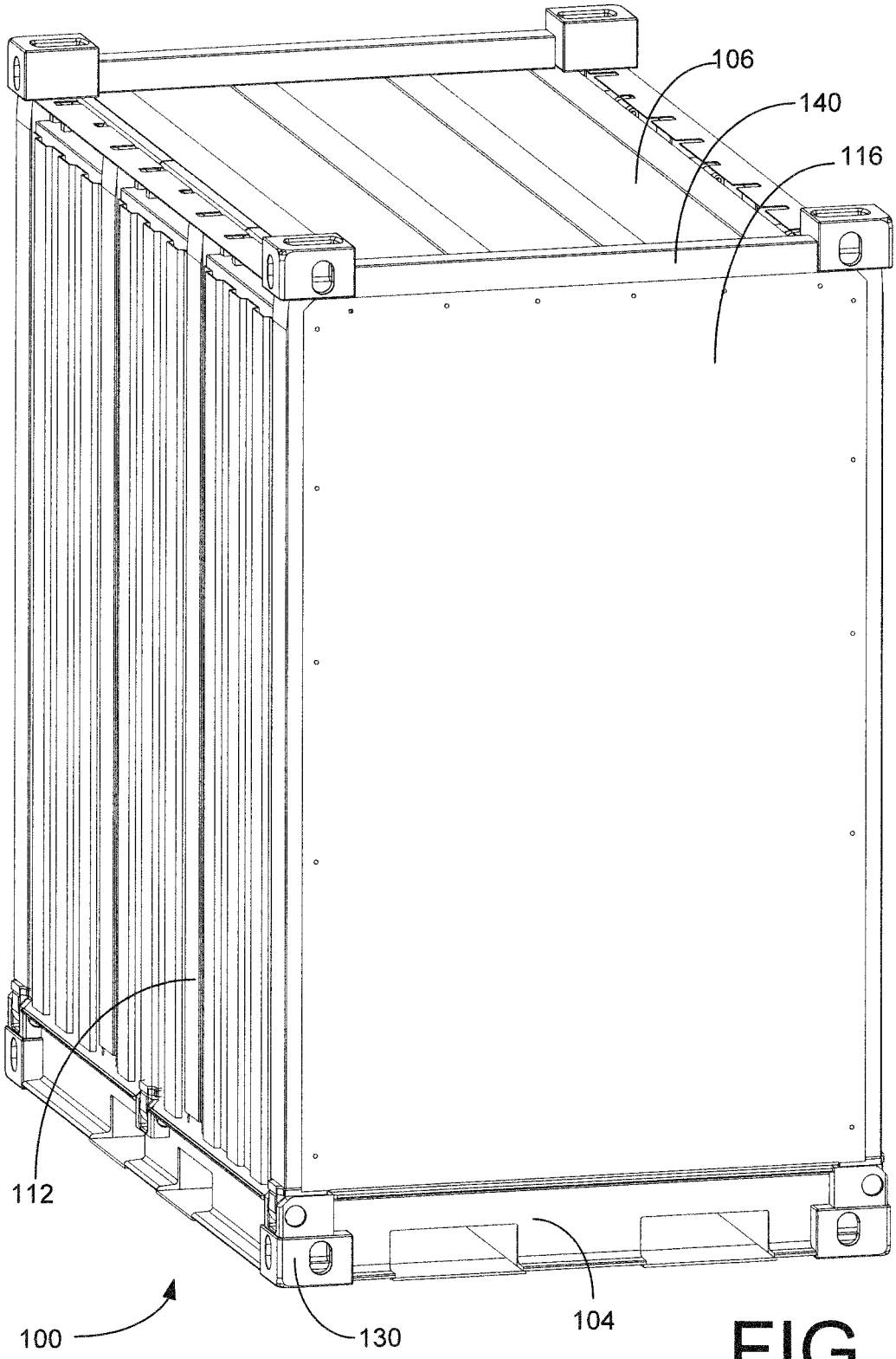
FIG. 2 is another perspective view of the traffic entry regulator unit.
Figure 3:
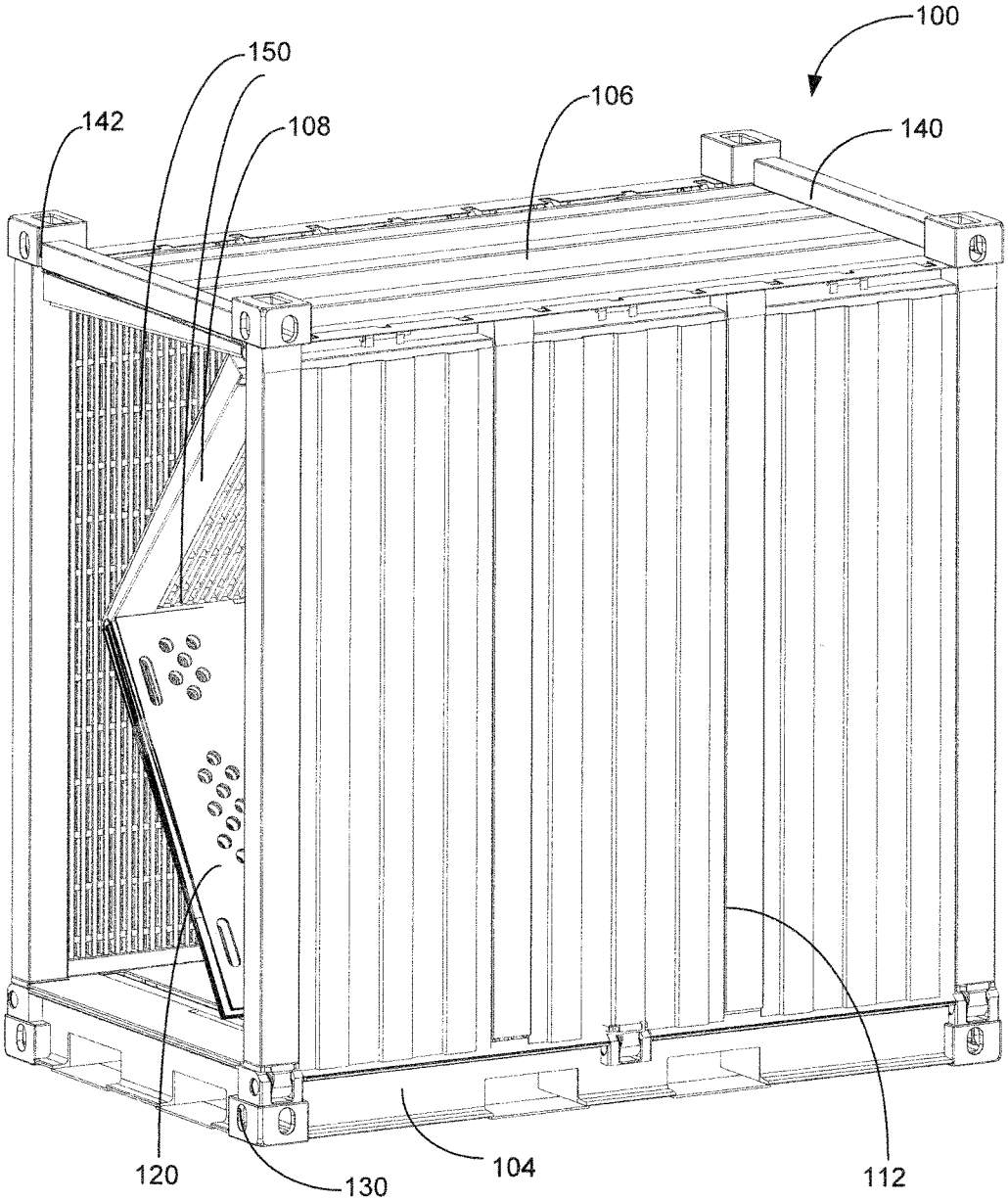
FIG. 3 is a perspective view of the traffic entry regulator unit with end panels removed to show an interior thereof.
Figure 4:
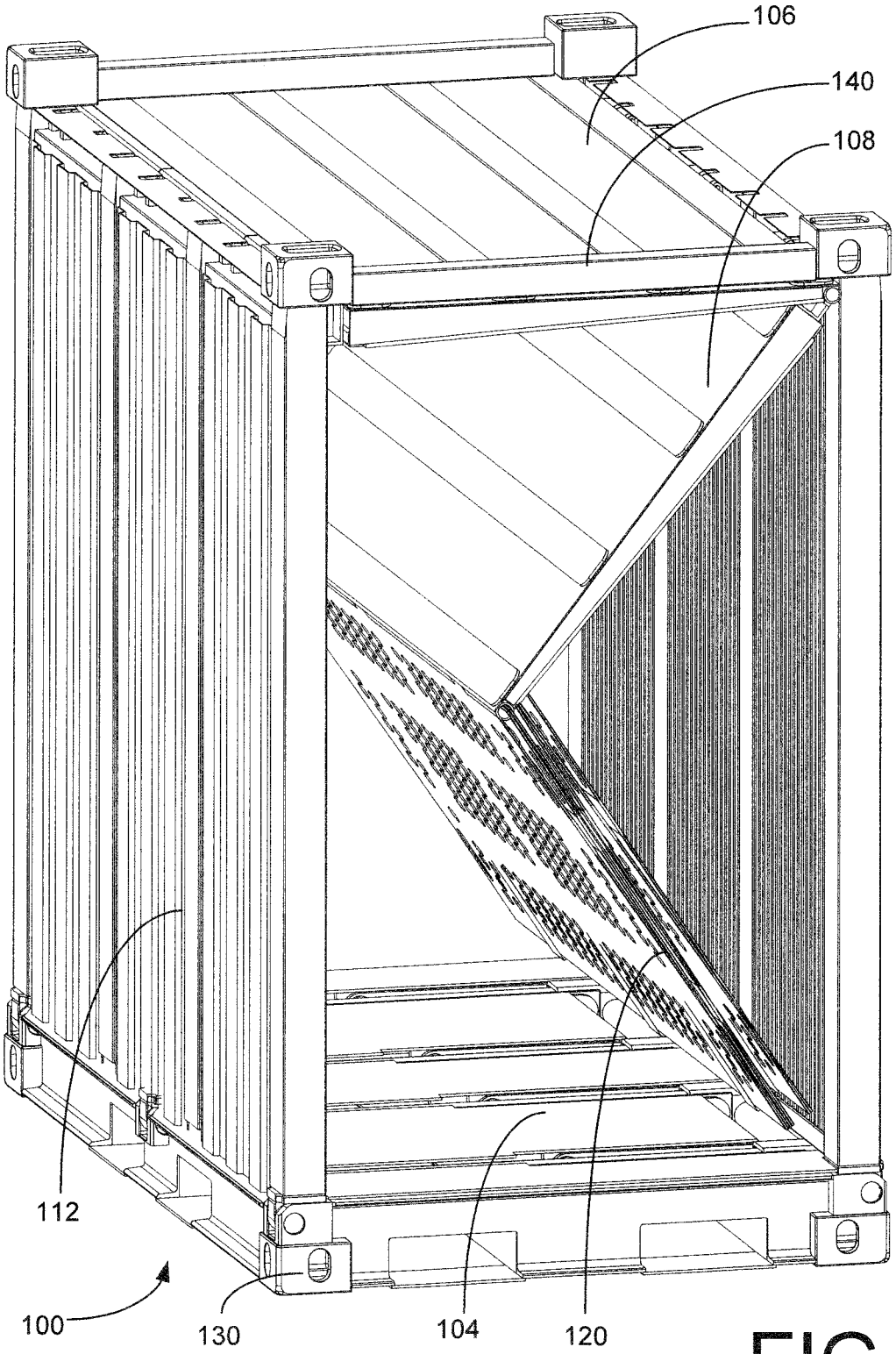
FIG. 4 is another perspective view of the traffic entry regulator unit with end panels removed.
Figure 5:
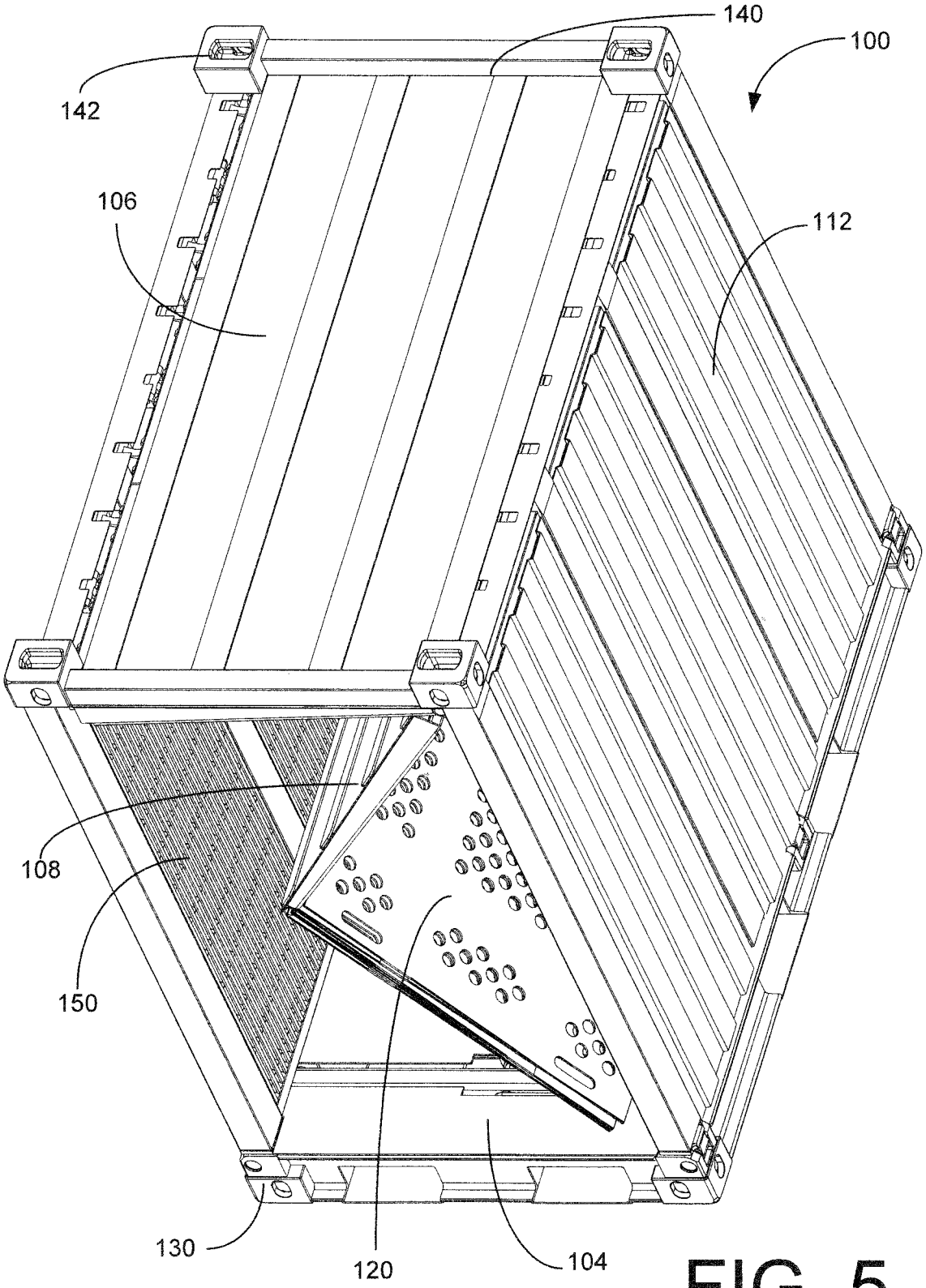
FIG. 5 is another perspective view of the traffic entry regulator unit with end panels removed.

FIG. 1 is a perspective view of a deployable expedient traffic entry regulator (DETER) unit 100 in a folded position according to an embodiment of the present invention. FIG. 2 is another perspective view of the traffic entry regulator unit 100. FIG. 3 is a perspective view of the traffic entry regulator unit 100 with end panels removed to show an interior thereof. FIG. 4 is another perspective view of the traffic entry regulator unit 100 with end panels removed. FIG. 5 is another perspective view of the traffic entry regulator unit 100 with end panels removed.

The container is typically an intermodal container, also known as a cargo or freight container, ISO container, shipping, sea or ocean container. One example of a suitable container 100 is a QuadCon. A QuadCon is a unique and versatile mini-container originally developed for use by the United States Armed Forces. The unit is configured to enable four containers to be secured together using the exclusive SeaLock connector. The resulting package has the same footprint as a standard 20' ISO intermodal container. Each QuadCon unit has a base that allows four-way forklift entry.

The traffic entry regulator unit 100 is a rectangular container in the folded position. The container includes a floor or base structure assembly 104, two top panels (one ceiling top panel 106 and one stowed top panel 108), two side walls 112, and two end panels 116. The base structure assembly 104 is rotatably connected on one side with one side wall 112 and the ceiling top panel 106 and on the other side with the other side wall 112, the stowed top panel 108, and a horizontal barrier component 120. These structural components are typically made of weathering steel or Corten steel. In a specific embodiment, the base assembly 104 and stowed top panels 108 are each about 8'×4.75' in size, and the side walls 112 are each 8'×8' in size.

In specific embodiments, the end panels 116 at the two ends are light-weight panels or membranes that can be easily removed and be stored or set aside during deployment. At the base are four base corner members 130 at four corners of the base structure assembly 104. At the top are a pair of top corner crossbars 140 connecting and securing opposite top corners of the two side walls 112. Each top corner crossbar 140 incorporates two corner blocks 142 (e.g., ISO 1161 corner blocks) that function to retain the ceiling top panel 106 and the stowed top panel 108 in the folded position. Using ISO corner blocks meets the ISO container standard envelope by providing corner connectors at each box corner at specified locations. The side walls 112, ceiling top panel 106, and stowed top panel 108 have grate decking units 150 attached to the interior surfaces thereof.

Figure 6:
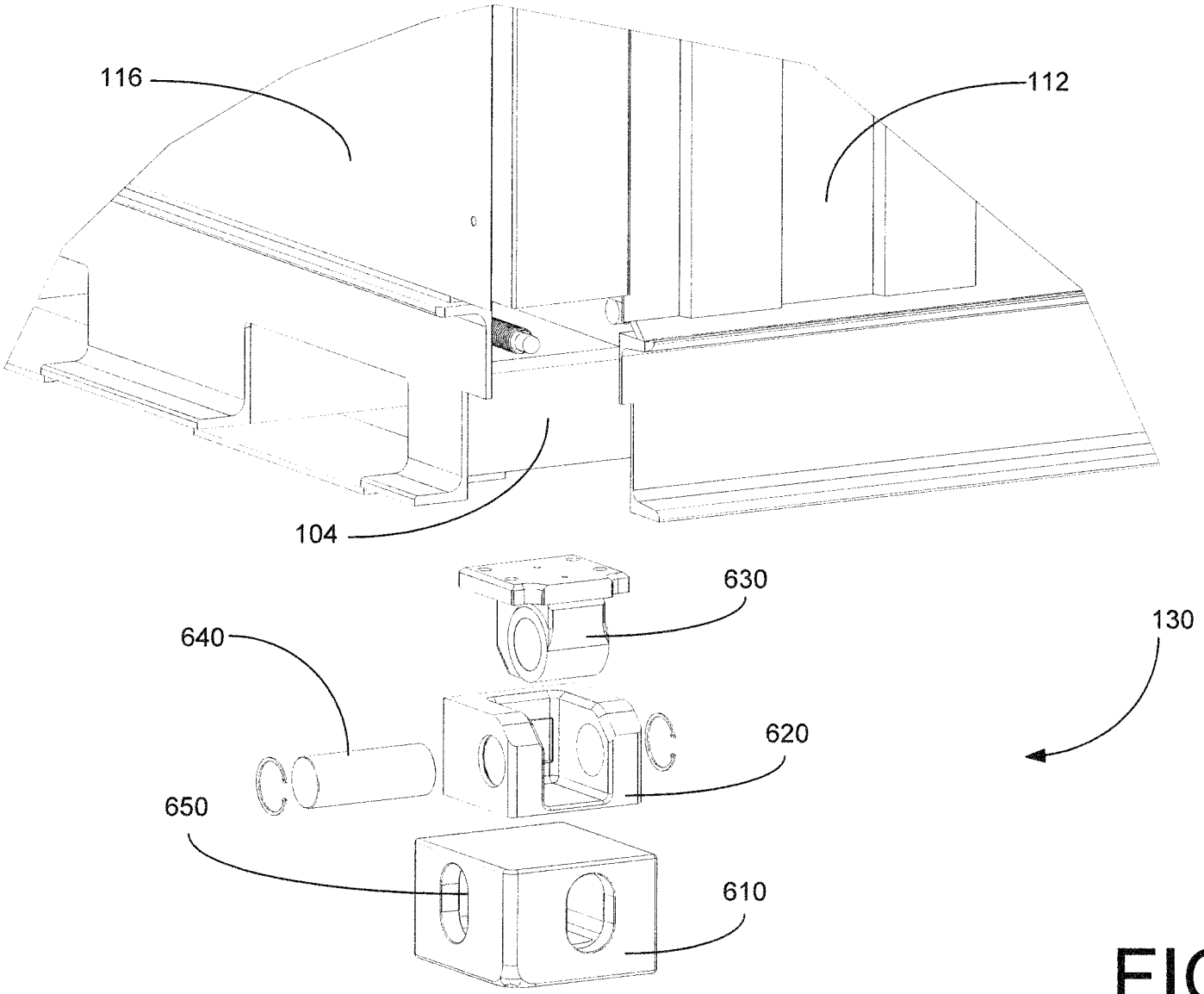
FIG. 6 is an exploded view of an example of a base corner member.

FIG. 6 is an exploded view of an example of a base corner member. The base corner member 130 includes a corner connector block 610 attached to the base structure assembly 104 and a ramp hinge subassembly which has a hinge body 620, a hinge post subassembly 630, and a hinge pin 640. The corner block 610 may be an off-the-shelf ISO 1161 steel casting that meets ISO 1161 standard for shipping container corner geometry. The hinge body 620 is welded to the ISO corner 610 and other base structure 104 and forms the fixed or stationary portion of the ramp hinge subassembly. The hinge post subassembly (SA) 630 is a welded subassembly that is free to rotate about the axis of the hinge pin 640, and is attached (e.g., welded) to the bottom of the side wall 112 to allow it to pivot downward to the ground (to form a vehicle ramp) during deployment from the folded position to the unfolded position. The hinge pin 640 fits through openings of the hinge body 620 and hinge post subassembly 630, and is held in place by two C-clips or snap-rings, to rotatably couple them together to form rotational degree of freedom for the ramp hinge subassembly. The corner block 610 is hollow and includes a side opening 650 that faces a direction that is parallel to the rotational axis of the hinge pin 640, which is parallel to the proximal edges and distal edges of the side walls 112. The side opening 650 is elliptical or elongated in the vertical direction and, as discussed below, is configured to receive a connection tool for modularly connecting adjacent traffic entry regulators 100 together at the corners.

Figure 7:
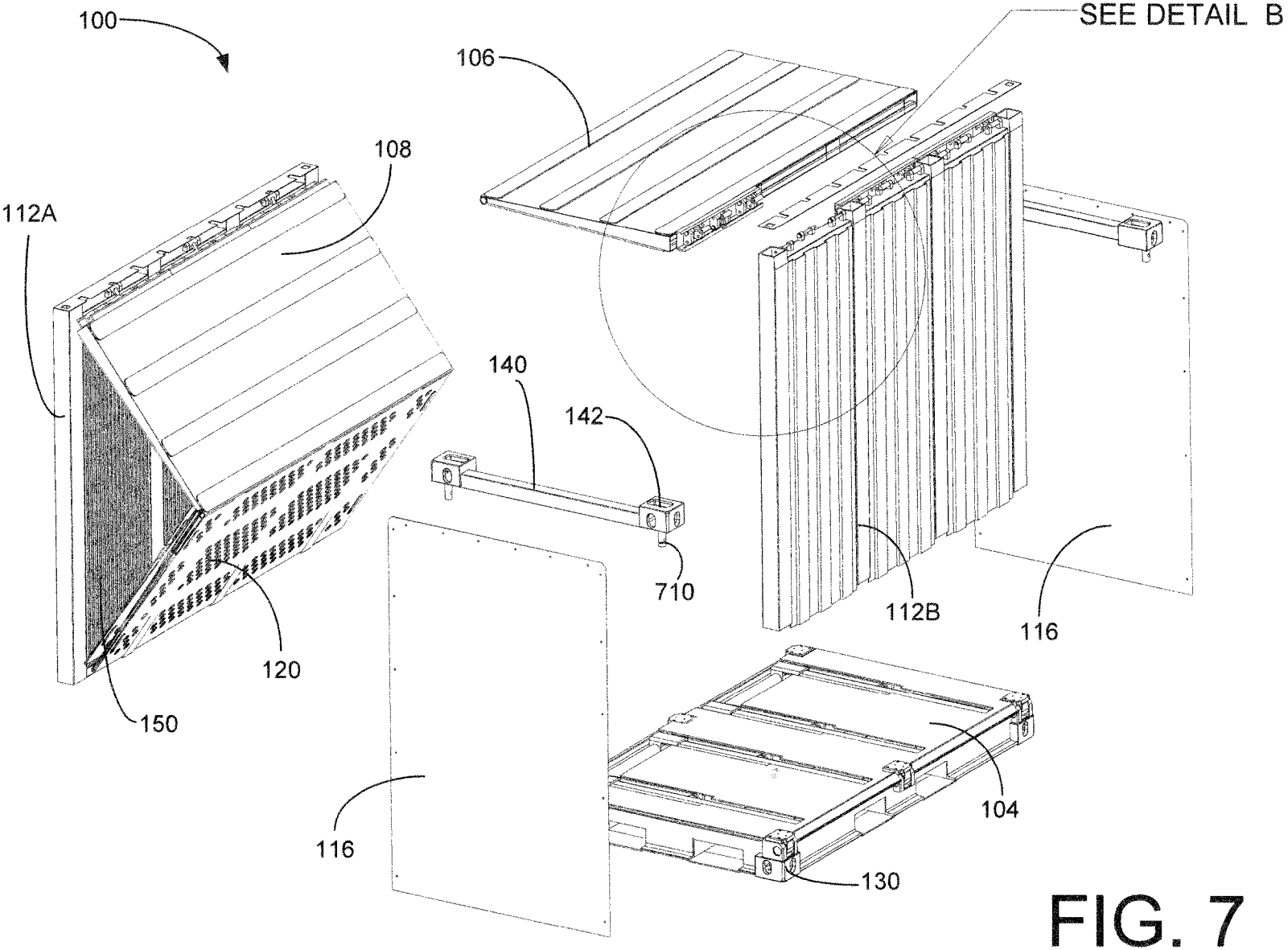
FIG. 7 is an exploded view of the traffic entry regulator unit of FIG. 1.

FIG. 7 is an exploded view of the traffic entry regulator unit of FIG. 1. The traffic entry regulator unit 100 includes the floor or base structure assembly 104, two top panels (one ceiling top panel 106 and one stowed top panel 108), two side walls 112, and two end panels 116. At the base are the four base corner members 130 at four corners of the base structure assembly 104. At the top are the pair of top corner crossbars 140 connecting and securing opposite top corners of the two side walls 112. Each top corner crossbar 140 incorporates two top corner blocks 142 that function to retain the ceiling top panel 106 and the stowed top panel 108 in the folded position. Each top corner block 142 includes a top corner pin 710 that is releasably connected to a top corner of the side wall 112, by pushing the top corner pins 710 downward to connect and lifting the top corner pins 710 to disconnect. The side walls 112, ceiling top panel 106, and stowed top panel 108 have grate decking units 150 attached to the interior surfaces thereof.

The two side walls 112 include an entry (first) side wall 112A and an exit (second) side wall 112B. In the unfolded position, the entry side wall 112A is an entry ramp disposed on the entry side and the exit side wall 112B is an exit ramp disposed on the exit side of the traffic entry regulator unit 100. The (first distal top edge of the) entry (first) side wall 112A is rotatably connected to (the proximal stowed top edge of) the stowed top panel 108, which is an entry toe ramp in the unfolded position. The (second distal top edge of the) exit (second) side wall 112B is rotatably connected to (the proximal ceiling top edge of) the ceiling top panel 106, which is an exit toe ramp in the unfolded position. As such, the ceiling top 106 and stowed top 108 each have a tapered thickness that tapers from a thicker proximal ceiling/stowed top edge to a thinner distal ceiling/stowed top edge to provide the toe ramps in the unfolded position. Detail B of the rotational or hinged connection between the exit side wall 112B and the ceiling top panel 106 is illustrated in FIG. 8.

Figure 8:
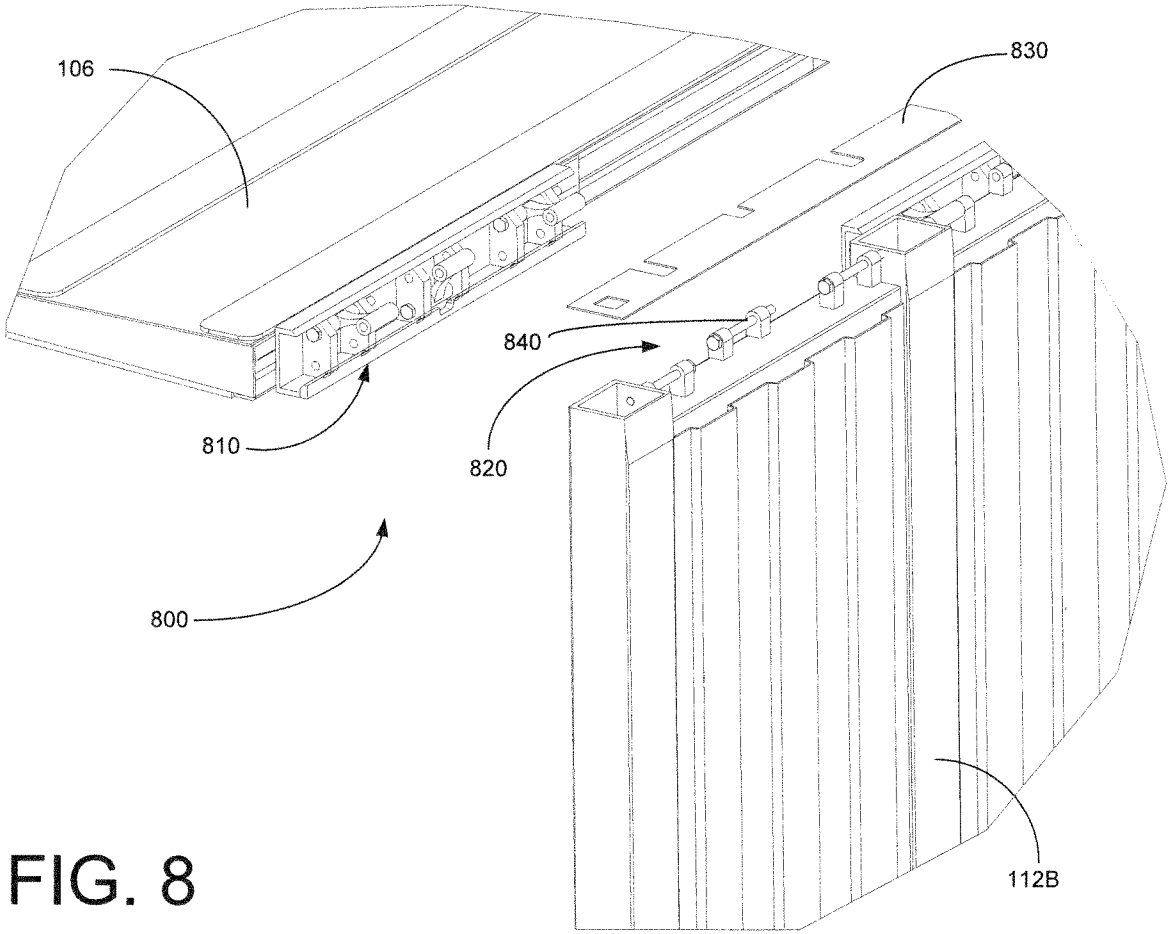
FIG. 8 is an exploded view of an example of a rotational connection between an exit side wall and the ceiling top panel, showing Detail B of FIG. 7.

FIG. 8 is an exploded view of an example of a rotational connection between an exit side wall 112B and the ceiling top panel 106, showing Detail B of FIG. 7. The connection is provided by an exit toe ramp hinge assembly 800, which includes a distal exit toe ramp hinge body subassembly 810, a proximal exit toe ramp hinge body subassembly 820, and an exit top skin plate 830. A plurality (e.g., three) of these exit toe ramp hinge assemblies 800 are provided along the length of the ceiling top panel 106 and exit side wall 112B.

The distal exit toe ramp hinge body subassembly 810 is attached (e.g., welded) to an end of the ceiling top panel 106 to form a hinge joint via hinge linkage members with the distal exit toe ramp hinge subassembly 820 to allow and control rotation of the ceiling top panel 106 from the folded position to the unfolded position to form an exit toe ramp on the ground. This hinged connection is created using a four bar linkage concept to allow the ceiling top panel 106 to rotate from a bottomed out position at perpendicular to the top of the exit side wall 112B, up and around the top of the exit side wall 112B, into the deployed position as the exit toe ramp on the ground. The exit top skin plate 830 is typically a steel plate that forms a cover over the exit toe ramp hinge linkage mechanism. The cover is on top in the folded position of the container.

Each proximal exit toe ramp hinge body subassembly 820 includes three pairs of proximal exit ramp hinge tabs that are attached (e.g., welded) to the top of the exit side wall 112B at three locations distributed along the length as shown (the middle pair being offset from the end pairs which are aligned) and combined with a standard ½" diameter proximal bolt or bar 840, forming "fixed" proximal end pivot points for the three individual hinge linkage members.

Figure 9:
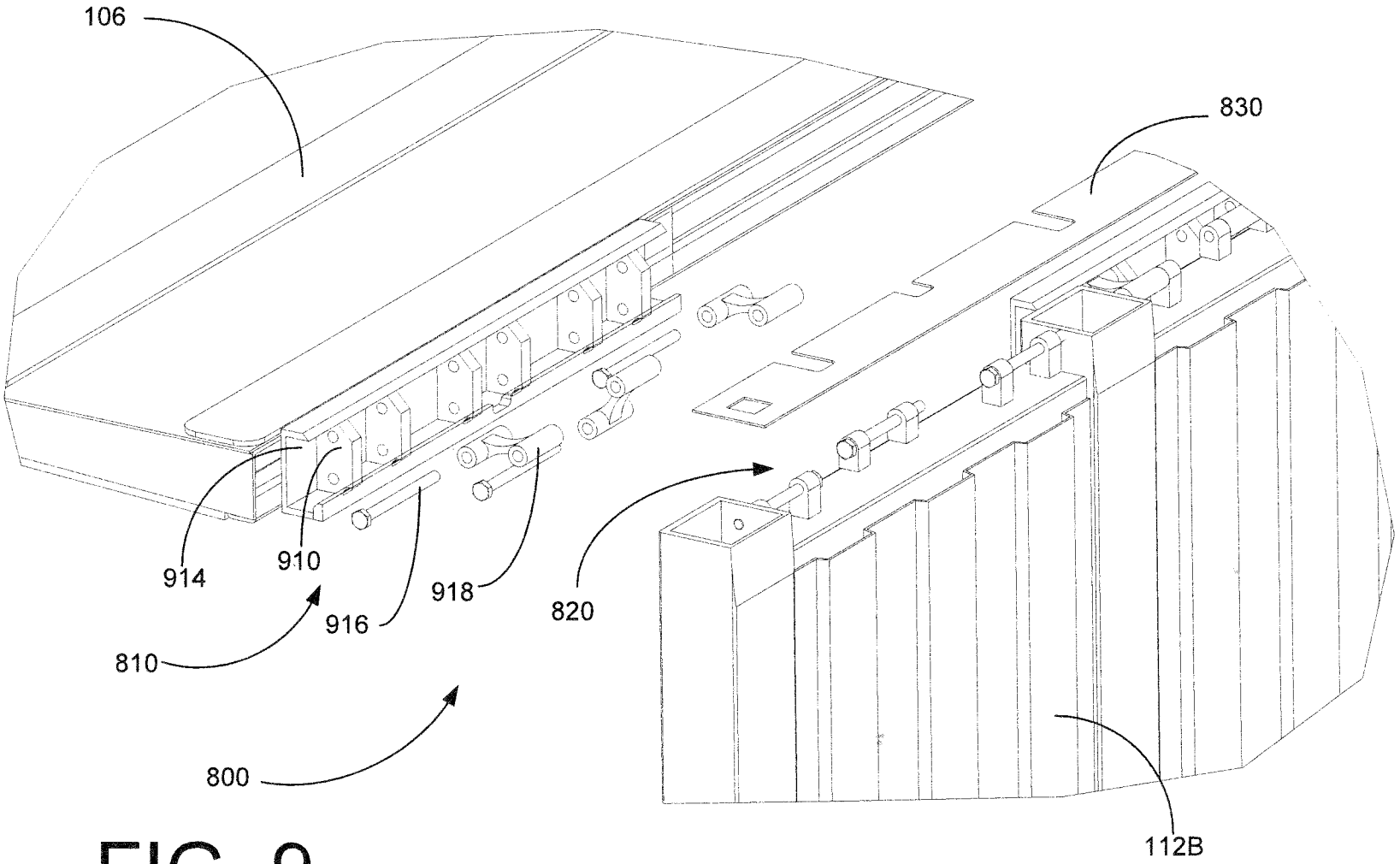
FIG. 9 is an exploded view of the distal exit toe ramp hinge body subassembly of FIG. 8.
Figure 10:
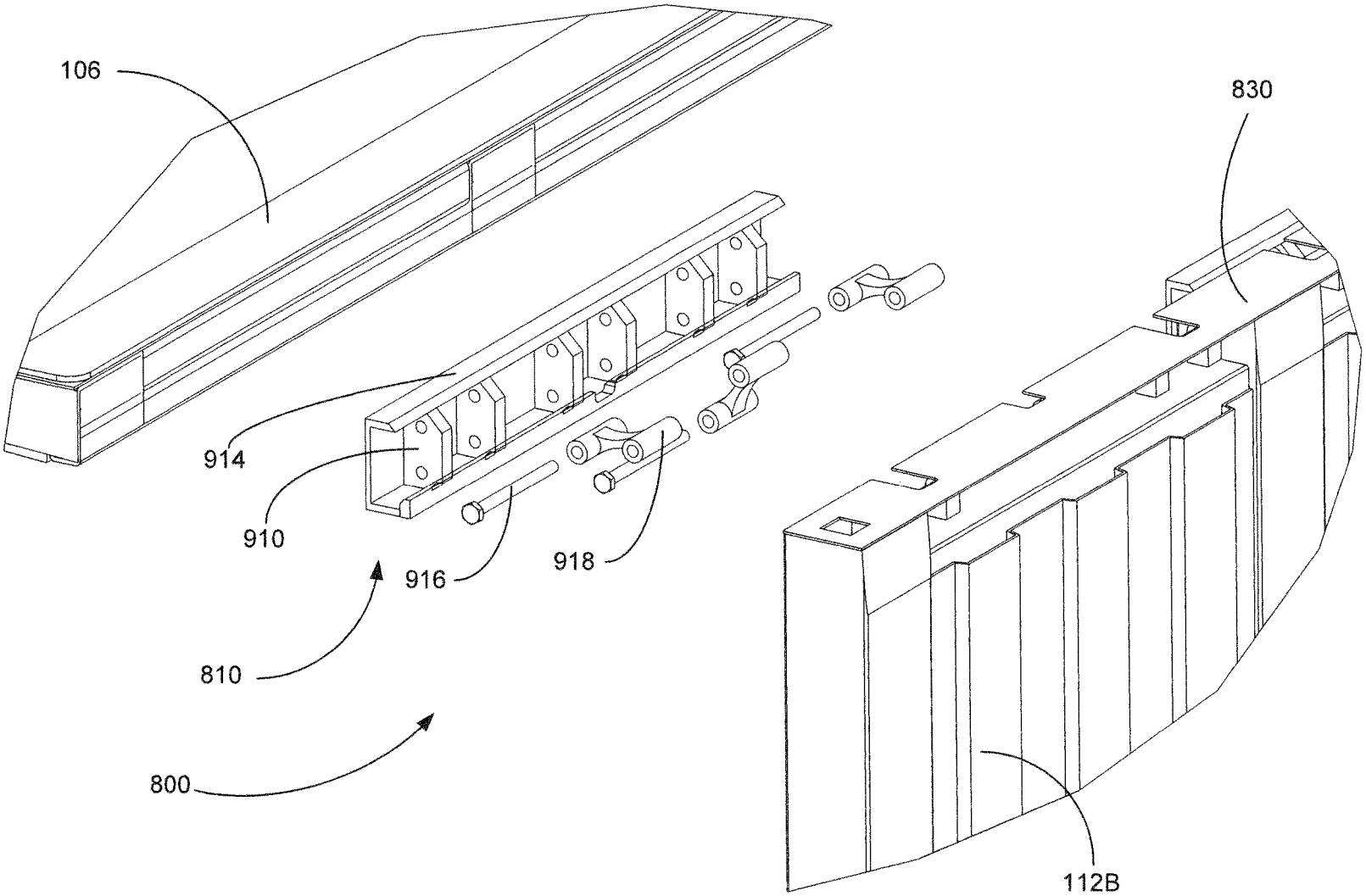
FIG. 10 is another exploded view of the distal exit toe ramp hinge body subassembly 810 of FIG. 8.

FIG. 9 is an exploded view of the distal exit toe ramp hinge body subassembly 810 of FIG. 8. FIG. 10 is another exploded view of the distal exit toe ramp hinge body subassembly 810 of FIG. 8. The subassembly 810 includes three pairs of distal exit toe ramp hinge tabs 910 that are attached to a channel 914 which is attached (e.g., welded) to the edge the ceiling top panel 106. Each pair of distal exit toe ramp hinge tabs 910 have upper and lower openings to receive a corresponding distal bolt or bar 916. The distal bolt 916 in the middle pair is coupled to the lower openings and the distal bolts 916 in the end pairs are coupled to the upper openings. The distal bolts 916 form distal end pivot points for the three individual hinge linkage members 918, which are hinge linkage bars having proximal and distal openings at two ends to receive the proximal bolts 916 and distal bolts 840, respectively. The offset arrangement of the distal bolts 916 in the distal exit toe ramp hinge body subassembly 810 complements the offset arrangement of the proximal bolts 840 in the proximal exit toe ramp hinge body subassembly 820. This hinge mechanism having compound rotational movement is configured based on a simple 4-bar linkage concept. The hinge geometry, namely the pivot point locations and "bar" lengths, are defined to provide specific range of motion for each configuration of the hinge.

Figure 11:
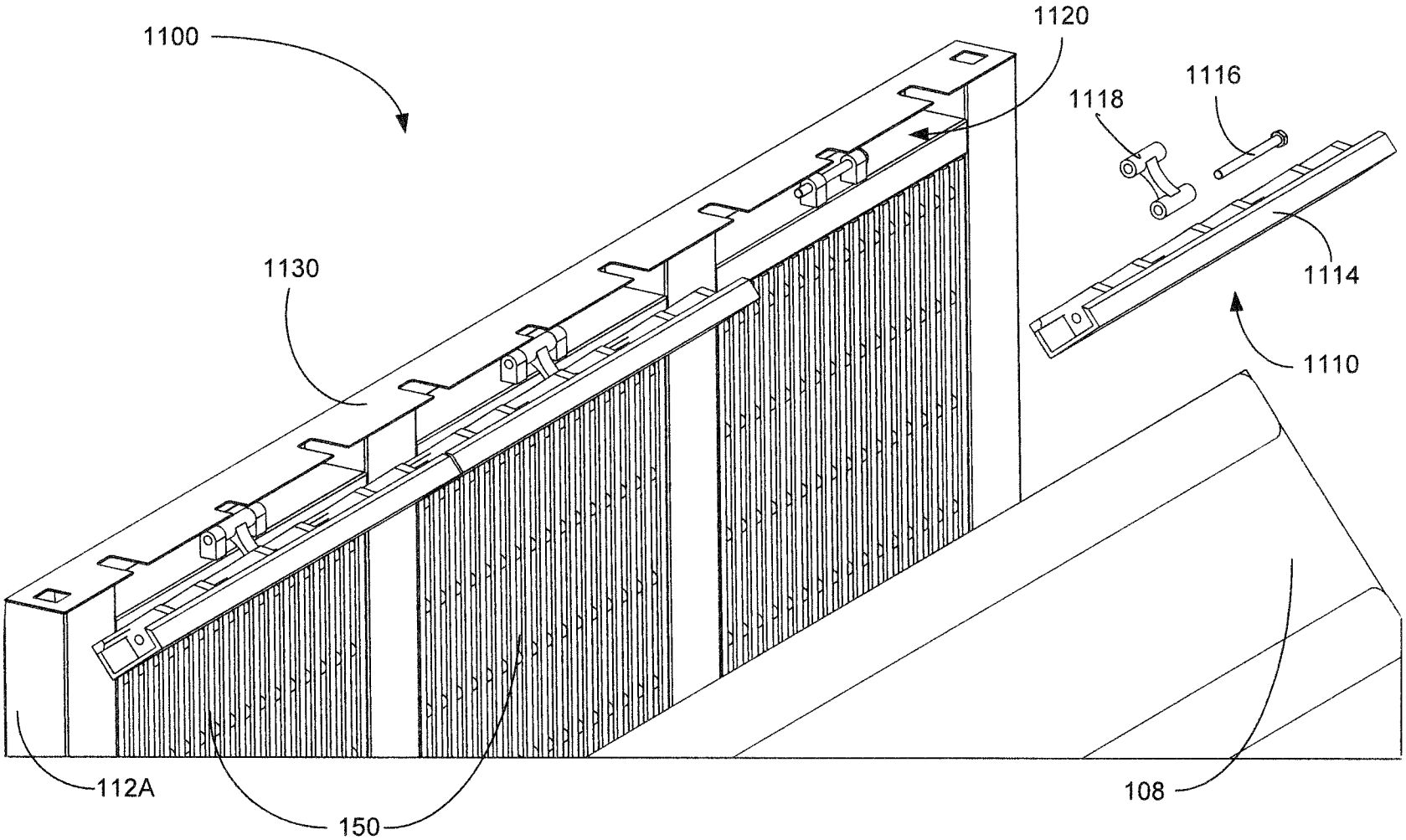
FIG. 11 is an exploded view of an example of a rotational connection between an entry side wall and the stowed top panel.

FIG. 11 is an exploded view of an example of a rotational connection between an entry side wall 112A and the stowed top panel 108. The connection is provided by an entry toe ramp hinge assembly 1100, which includes a distal entry toe ramp hinge body subassembly 1110, a proximal entry toe ramp hinge body subassembly 1120, and an entry top skin plate 1130. A plurality (e.g., three) of these entry toe ramp hinge assemblies 1100 are provided along the length of the stowed top panel 108 and entry side wall 112A. The distal entry toe ramp hinge body subassembly 1110 is attached (e.g., welded) to an end of the stowed top panel 108 to form a hinge joint via hinge linkage members with the distal entry toe ramp hinge subassembly 1120 to allow and control rotation of the stowed top panel 108 from the folded position to the unfolded position to form an entry toe ramp on the ground. This hinged connection is provided to allow the stowed top panel 108 to rotate from a stowed position inside the folded container next to the top of the entry side wall 112A at about 45° to the entry side wall 112A, up and around the top of the entry side wall 112A, into the deployed position as the entry toe ramp on the ground. The entry top skin plate 1130 is typically a steel plate that forms a cover over the entry toe ramp hinge linkage mechanism. The cover is on top in the folded position of the container.

Figure 12:
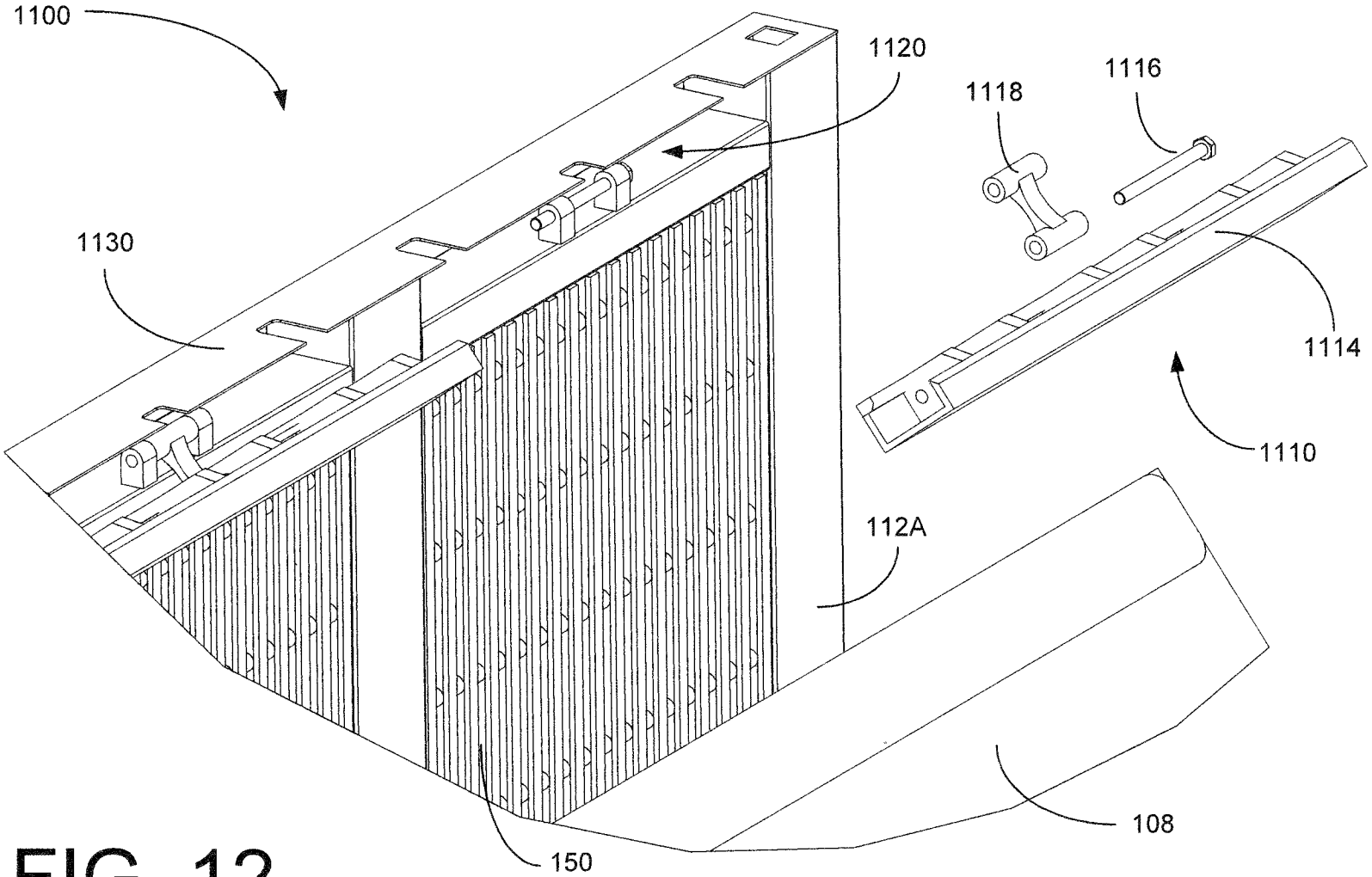
FIG. 12 is another exploded view of the entry toe ramp hinge assembly of FIG. 11.

FIG. 12 is another exploded view of the entry toe ramp hinge assembly of FIG. 11. The distal entry toe ramp hinge body subassembly 1110 is similar to the distal exit toe ramp hinge body subassembly 810, the proximal entry toe ramp hinge body subassembly 1120 is similar to the proximal exit toe ramp hinge body subassembly 820, and the entry top skin plate 1130 is similar to the exit top skin plate 830. The exit toe ramp hinge assembly 800 is somewhat different from the entry toe ramp hinge assembly 1100 because they provide differing rotational degrees of freedom for movement needed for the exit wall toe ramp to form the roof and the entry wall toe ramp to fold down inside the container at about 45° in the folded position, respectively. As seen in FIGS. 11 and 12, only the middle distal bolt or bar 1116 and middle hinge linkage member or bar 1118 are used. There is no need for the two offset distal bolts and hinge linkage bars to provide the offset configuration in the exit toe ramp hinge assembly 800.

Figure 13:
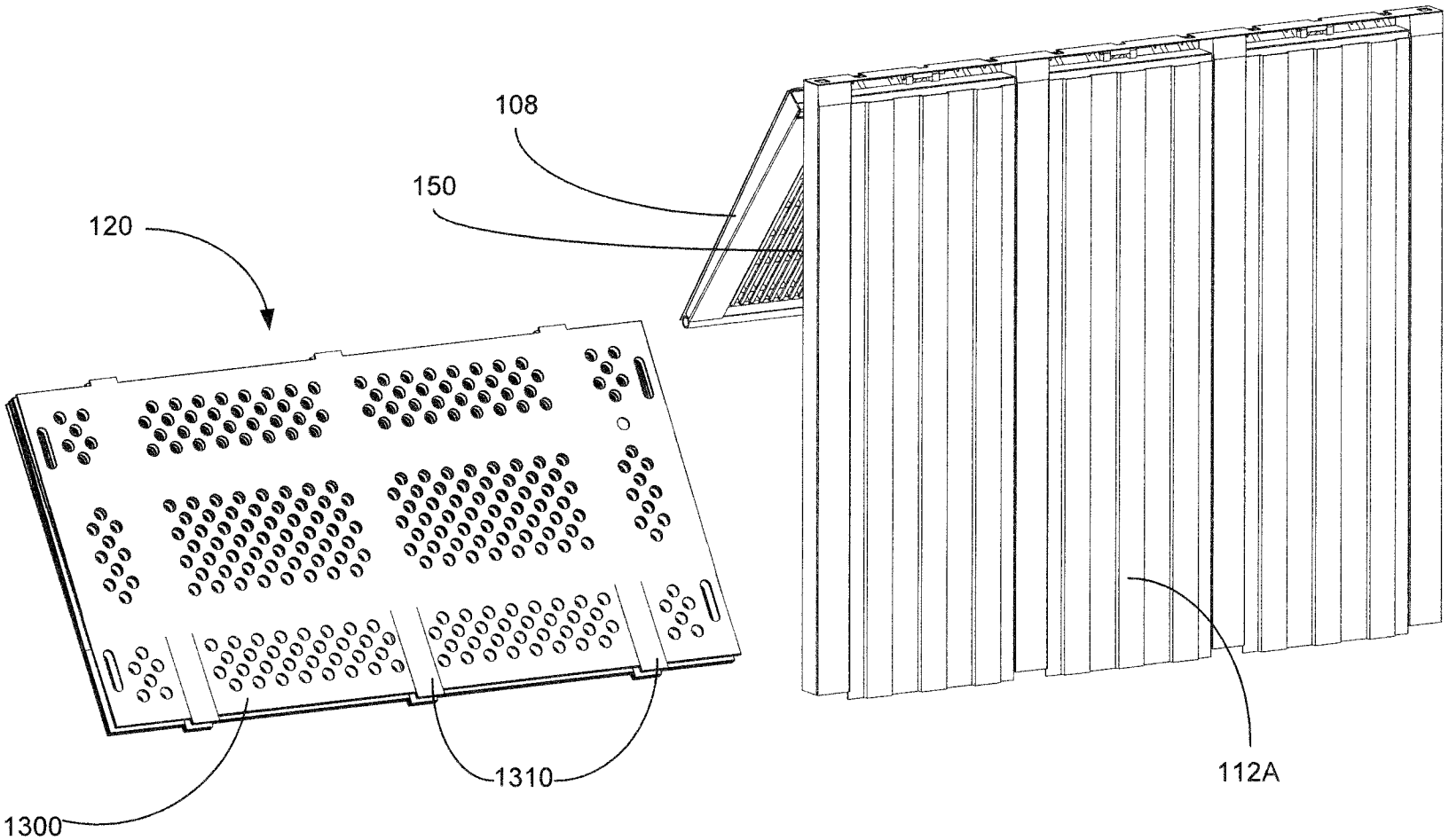
FIG. 13 shows an example of the horizontal barrier component in an undeployed position in an exploded view that includes the entry side wall and the stowed top panel having the grate decking.

FIG. 13 shows an example of the horizontal barrier component 120 in an undeployed position in an exploded view that includes the entry side wall 112A and the stowed top panel 108 having the grate decking 150. In the undeployed position, the horizontal barrier component 120 includes a plurality of matting panels or mat sections 1300 folded in an accordion manner. In a specific embodiment, three integrated continuous 4" straps 1310 link six 4'×8' matting panels 1300 folded in the accordion manner, as seen in FIG. 13.

Figure 14:
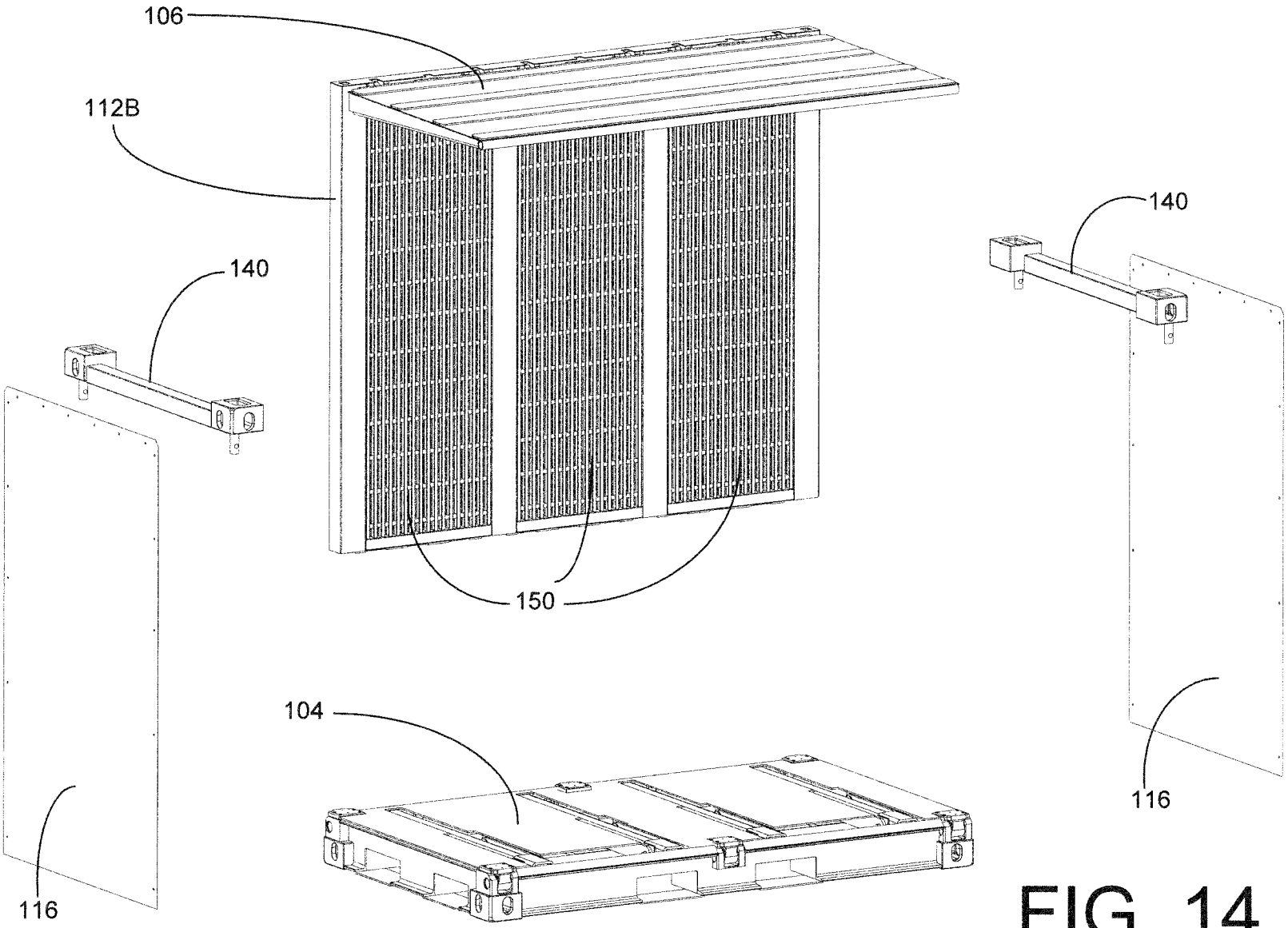
FIG. 14 is another exploded view of the traffic entry regulator unit of FIG. 1, less the subassemblies of FIG. 13.

FIG. 14 is another exploded view of the traffic entry regulator unit of FIG. 1, less the subassemblies of FIG. 13. This view of the traffic entry regulator unit 100 includes the base 104, ceiling top panel 106 hingedly connected to the exit side wall 112B, end panels 116, and top corner crossbars 140. The exit side wall 112B has three grate decking units 150 attached to the interior surface thereof. Similarly, the entry side wall 112A has three grate decking units 150 attached to the interior surface thereof.

Figure 15:
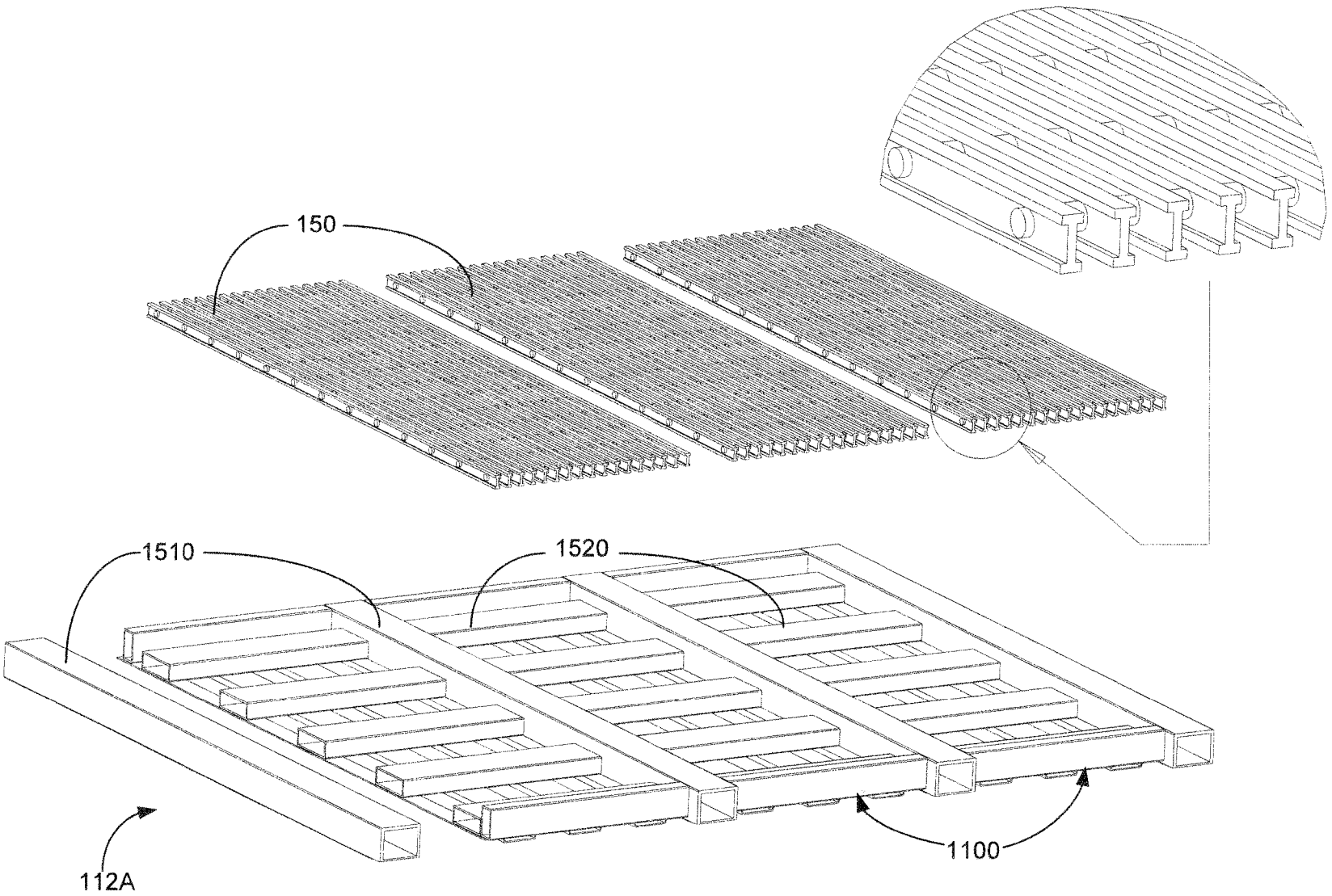
FIG. 15 is an exploded view of the entry side wall in the unfolded position with three grate decking units.
Figure 16:
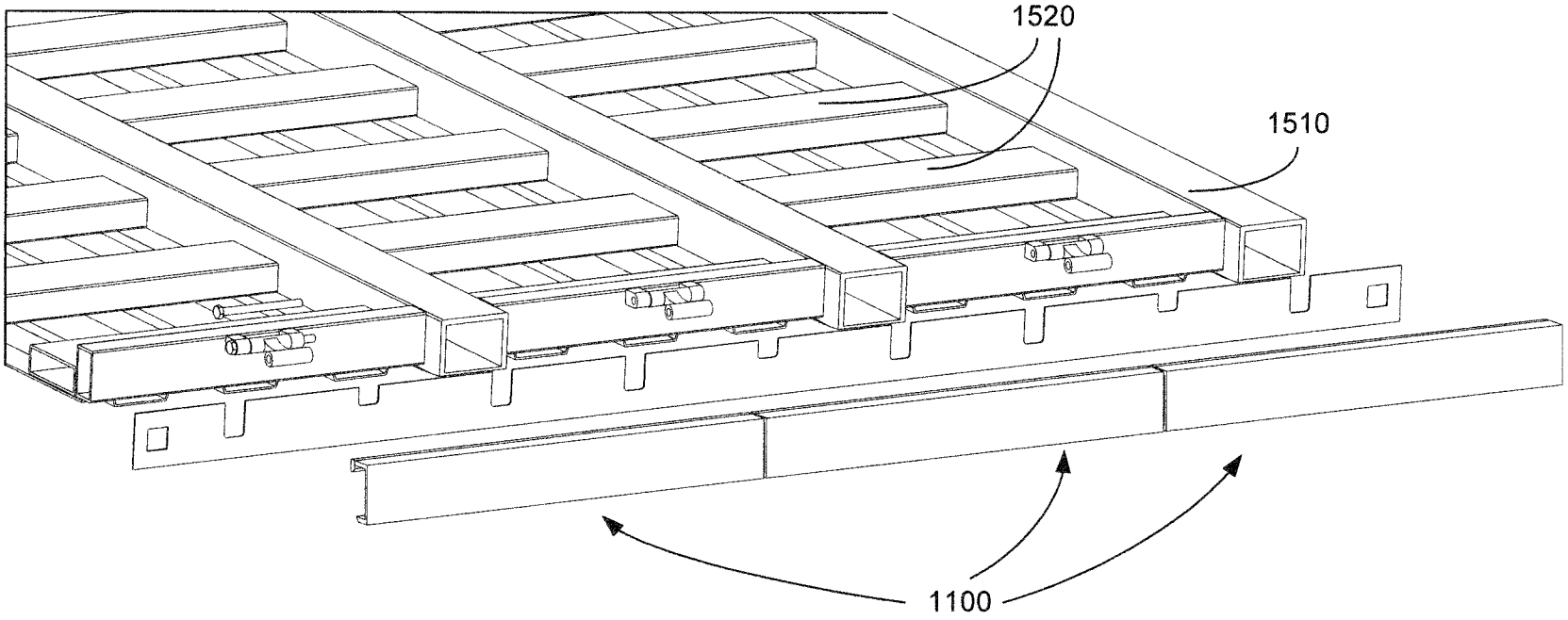
FIG. 16 is an exploded view of the entry toe ramp hinge assembly in the unfolded position.

FIG. 15 is an exploded view of the entry side wall 112A in the unfolded position with three grate decking units 150. The exit side wall 112B has a similar structure/construction. In other embodiments, there may be one or two wider grate decking units or four or more narrower grate decking units. FIG. 16 is an exploded view of the entry toe ramp hinge assembly 1100 in the unfolded position. The entry toe ramp hinge assembly 1100 is shown at the distal edge of the entry side wall 112A for hinged connection to the stowed top panel 108.

In the unfolded position, the entry side wall 112A is strong enough to carry the heavy load of a vehicle such as a large truck weighing up to about 30,000 pounds. In the embodiment shown in FIG. 15, four longitudinal hollow structural sections (HSS) members 1510 along the direction of vehicle travel serve as the main load-bearing structural members. These HSS members are also referred to herein as tubular beams or beams. They are connected by five lateral tubular beams 1520 (e.g., by welding). Three pockets are provided between the four longitudinal beams 1510 to receive the three grate decking units 150. One example of the grate decking unit 150 includes a plurality of I-beams oriented longitudinally along the direction of vehicle travel and interconnected in the lateral direction by a plurality of round lateral members. The grate decking units 150 distribute the load of the vehicle applied by the vehicle tires over the lateral beams 1520 which transfer the load partially to the longitudinal beams 1510. The grate decking units 150 are typically made of a composite material such as fiberglass. For example, the grate decking is made of SPF polyester resin having 1.5" height×0.6" top flange width I-bar, medium grit surface, 60% open area.

The exit side wall 112B may have the same structural components as the entry side wall 112A. The ceiling top panel 106 and stowed top panel 108 have similar grate decking units 150 attached to the interior surfaces thereof. To support heavy vehicles, the entry and exit side wall 112A, 112B each typically weigh about 1500 pounds. During unfolding of the container, these heavy side walls can be lowered to the ground and raised using an integrated winch provided in the container. Alternatively, an external lift mechanism can be utilized to handle and manipulate the heavy side walls.

Figure 17:
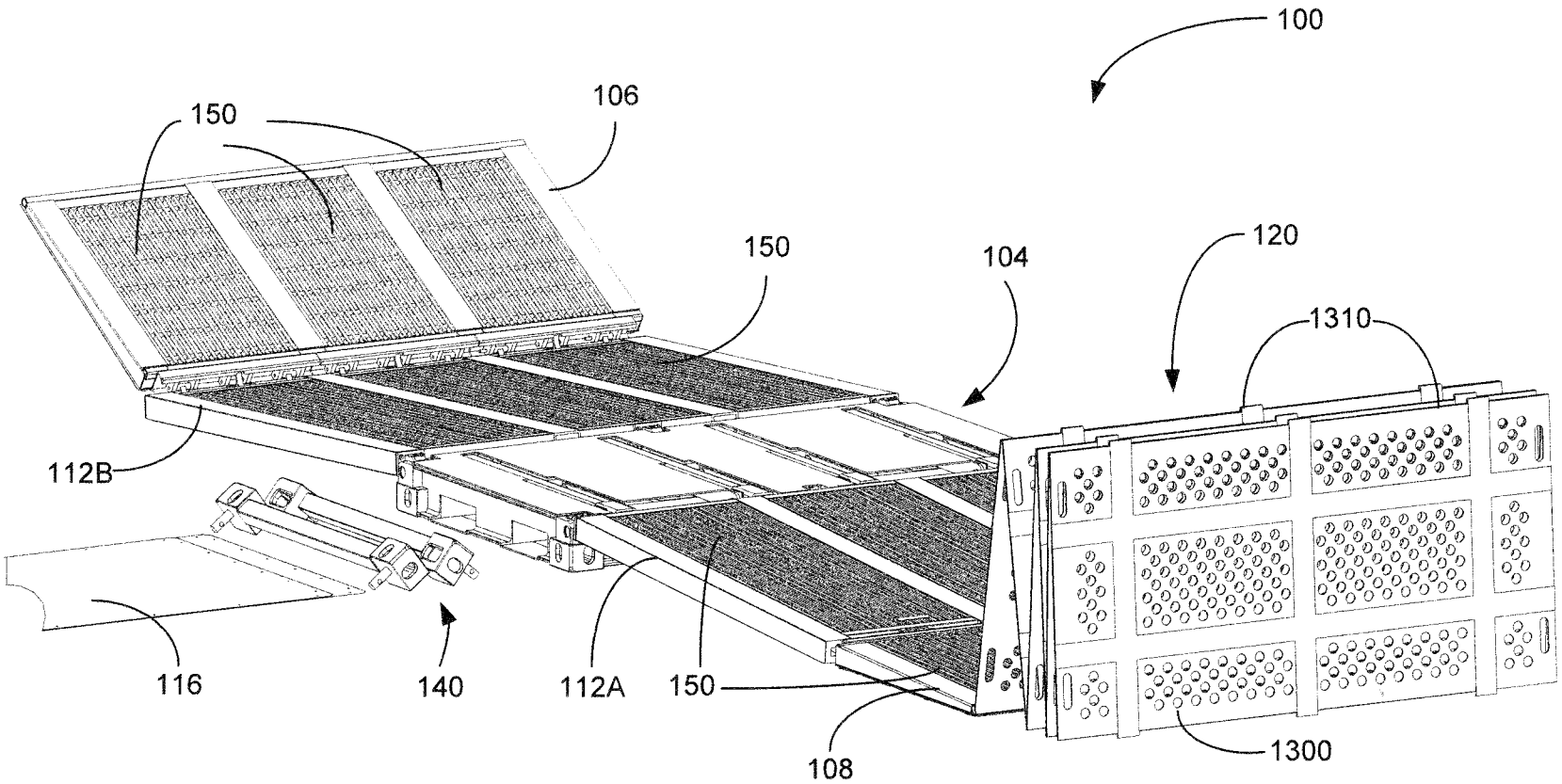
FIG. 17 is a perspective view of the traffic entry regulator unit of FIG. 1 in a partially unfolded position.

FIG. 17 is a perspective view of the traffic entry regulator unit 100 of FIG. 1 in a partially unfolded position. A vertical barrier component is hidden inside the base 104 in a passive barrier position. The matting panels 1300 of the horizontal barrier component 120 are folded in an accordion manner and held together by three integrated straps 1310. The surface of the base 104 is elevated above the ground by about 9". The base 104 is connected, on the upstream/entry side of traffic, to the entry side wall 112A as an entry up-ramp, the entry top panel 108 as an entry up-toe-ramp, and the horizontal barrier component 120. The base 104 is connected, on the downstream/exit side of traffic, to the exit side wall 112B as an exit down-ramp and the exit top panel 106 as the exit down-toe-ramp. The side-wall ramps 112A, 112B and the top-panel toe ramps 106, 108 have grate decking units 150 for load distribution. The top-panel toe ramps 106, 108 may be structurally similar to the side-wall ramps 112A, 112B, although they need not be as strong because the toe ramps rest on the ground. The matting panels 1300 of the horizontal barrier component 120 are connected to the distal end of the entry toe ramp 108, for instance, by the straps 1310. The end panels 116 and top corner crossbars 140 are removed and stowed.

Figure 18:
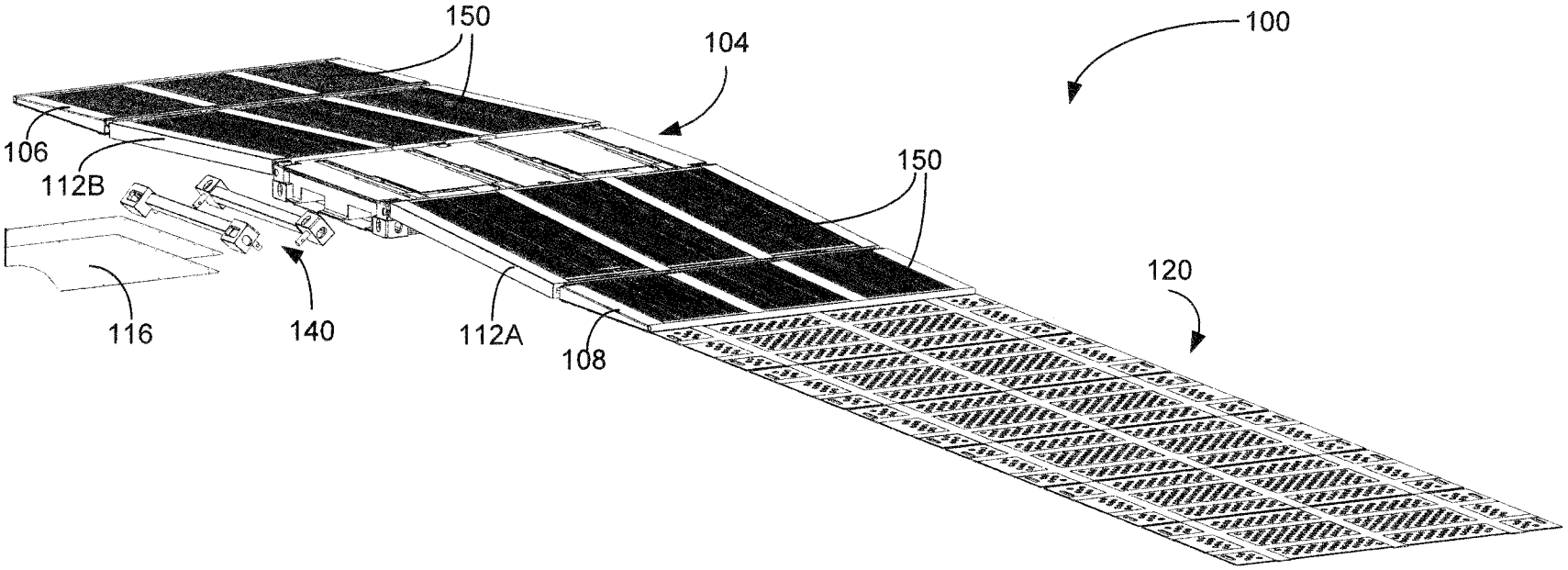
FIG. 18 is a perspective view of the traffic entry regulator unit of FIG. 1 in an unfolded, passive barrier position.

FIG. 18 is a perspective view of the traffic entry regulator unit 100 of FIG. 1 in an unfolded, passive barrier position. As compared to FIG. 17, the matting panels 1300 of the horizontal barrier component 120 are unfolded from the accordion position and stretched out on the ground.

Figure 19:
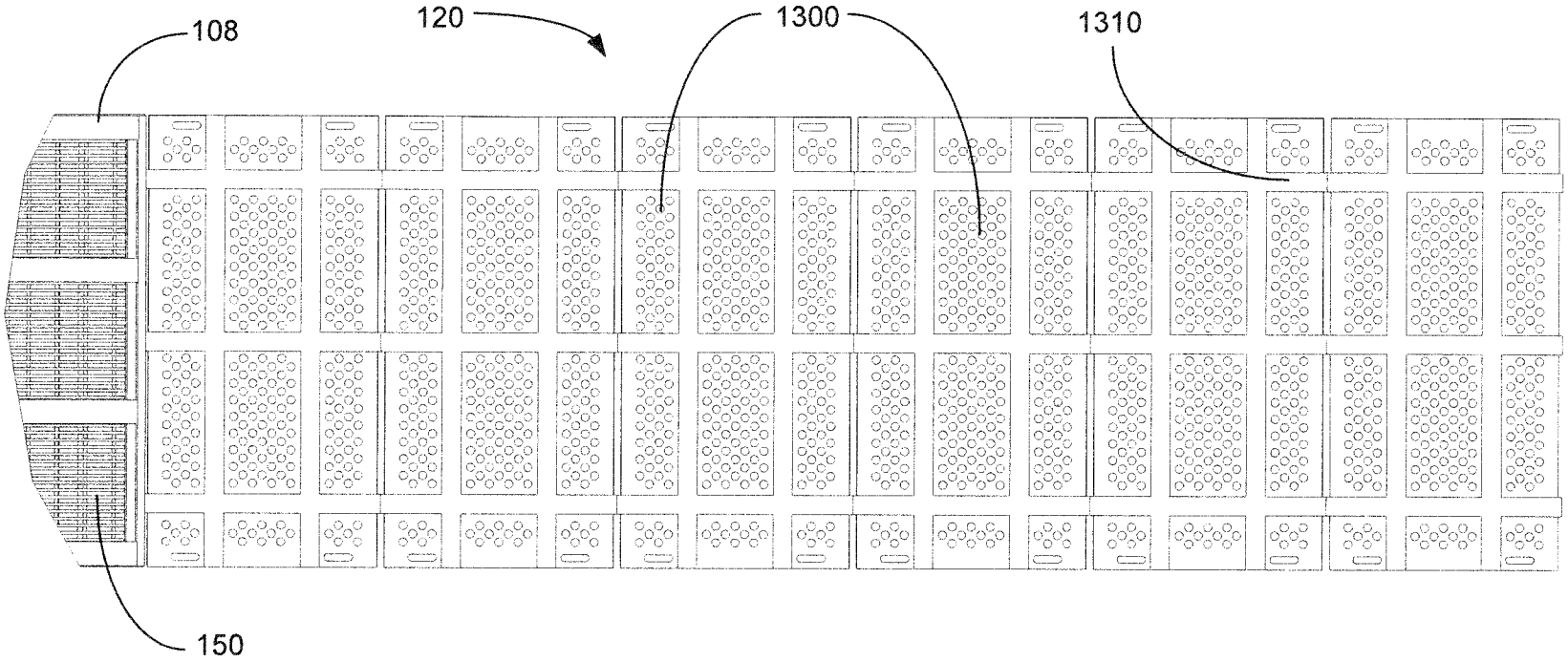
FIG. 19 is a top plan view of the horizontal barrier component in the unfolded position.

FIG. 19 is a top plan view of the horizontal barrier component 120 in the unfolded position. Six matting panels 1300 of the horizontal barrier component 120 are unfolded from the accordion configuration to lie on the ground upstream of the base 104, the entry up ramp 112A, and the entry toe ramp 108. The matting panels 1300 are connected in series to (the distal stowed top edge of) the stowed top 108 and form a longitudinal sliding friction mat to begin slowing down the approaching vehicles.

In specific embodiments, the horizontal barrier component 120 is similar to that disclosed in U.S. Pat. No. 10,024,008, which is a mesh made solely from a plurality of interconnected link components as disclosed in FIGS. 1*a*-1*e* and at column 2, line 26 to column 4, line 54, which is incorporated herein by reference. The horizontal barrier component is a friction-enhanced surface which creates a sliding friction interface upon contact of a moving vehicle with the vertical barrier component. It is a structure capable of preventing rolling of a vehicle tire relative to the road surface beneath the tire when placed between the vehicle tire and the road surface. The horizontal barrier component includes an upper barrier surface and a lower barrier surface having a friction-enhanced surface. The friction-enhanced surface is a surface which increases friction between horizontal barrier component and the road surface. Upon contact of a moving vehicle with a vertical barrier component, the friction-enhanced surface creates a sliding friction interface, at least one physical point of sliding contact between friction-enhanced surface and the road surface. The friction-enhanced surface has a minimum coefficient of kinetic friction with a road surface of approximately 0.3. In certain embodiments, the friction-enhanced surface includes at least one frictional structure, which increases the coefficient of kinetic friction between the road surface and horizontal barrier component. The frictional structures can include metal grating, at least one layer of elastomer, integral metal protrusions, welded metal angles or bolted metal angles. A lower surface of the horizontal barrier component is a friction-enhanced surface which creates a sliding friction interface upon contact of a moving vehicle with the vertical barrier component. The component, may be constructed of metal, fabric, nylon, other polymers, resins, carbon fiber, or composites thereof. Because horizontal barrier component prevents contact between the target vehicle and a road surface, the vehicle barrier apparatus skids along the road surface under the target vehicle's momentum.

Figure 20:
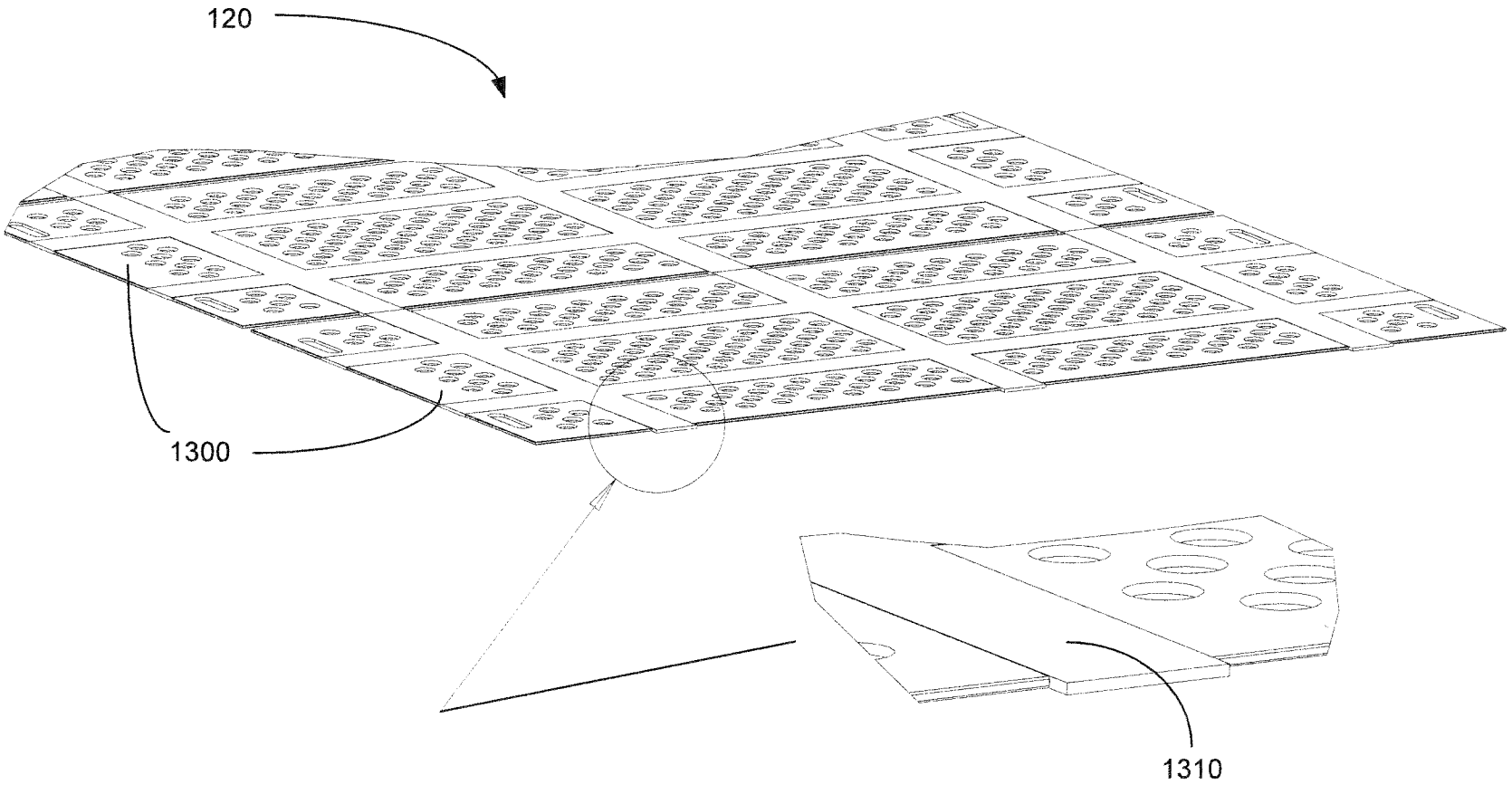
FIG. 20 shows a close-up view of the matting panels and integrated straps of the horizontal barrier component.

FIG. 20 shows a close-up view of the matting panels 1300 and integrated straps 1310 of the horizontal barrier component 120. One example of a friction-based matting panel is ACEMAT made of a composite material such as fiberglass selected for its material properties including durability under cyclic loading. The ACEMAT is a government-owned fiberglass matting system developed by the U.S. Army Corps of Engineers. The matting panels 1300 include a plurality of circular openings distributed over the surface area. The ACEMAT has integrated continuous 4" straps linking six 4'×8' matting panels 1300 that are folded in the accordion manner and unfolded during deployment. The three straps 1310 are typically made of polyester. To attach the horizontal barrier component 120 to the distal end of the stowed top panel 108 that serves as the up-toe-ramp, the straps 1310 may be affixed to the stowed top panel 108 using any available method.

In specific embodiments, the three 4" straps 1310 running lengthwise connecting all 6 matting panels 1300 are each fabricated with about 18 feet of strap hanging out the end of the ACEMAT assembly 120 that interfaces with the rest of the barrier. These strap "tails" will be fed through voids provided in the toe ramp 108, through a void in the entry side wall 112A and attach to hardpoint connections within the base assembly 104 (e.g., below the floor surface on top of the base assembly) of the barrier. In this way, the ACEMAT assembly 120 will be "pre-connected" when a traffic entry regulator unit 100 is unfolded. There may also be 2×4" strapping running in the transverse direction with excess hanging out of the 4'×8' fiberglass panel area such that connection can be made (e.g., using mechanical buckles) the ACEMAT assemblies of multiple joined traffic entry regulator units to provide multiple widths.

Figure 21:
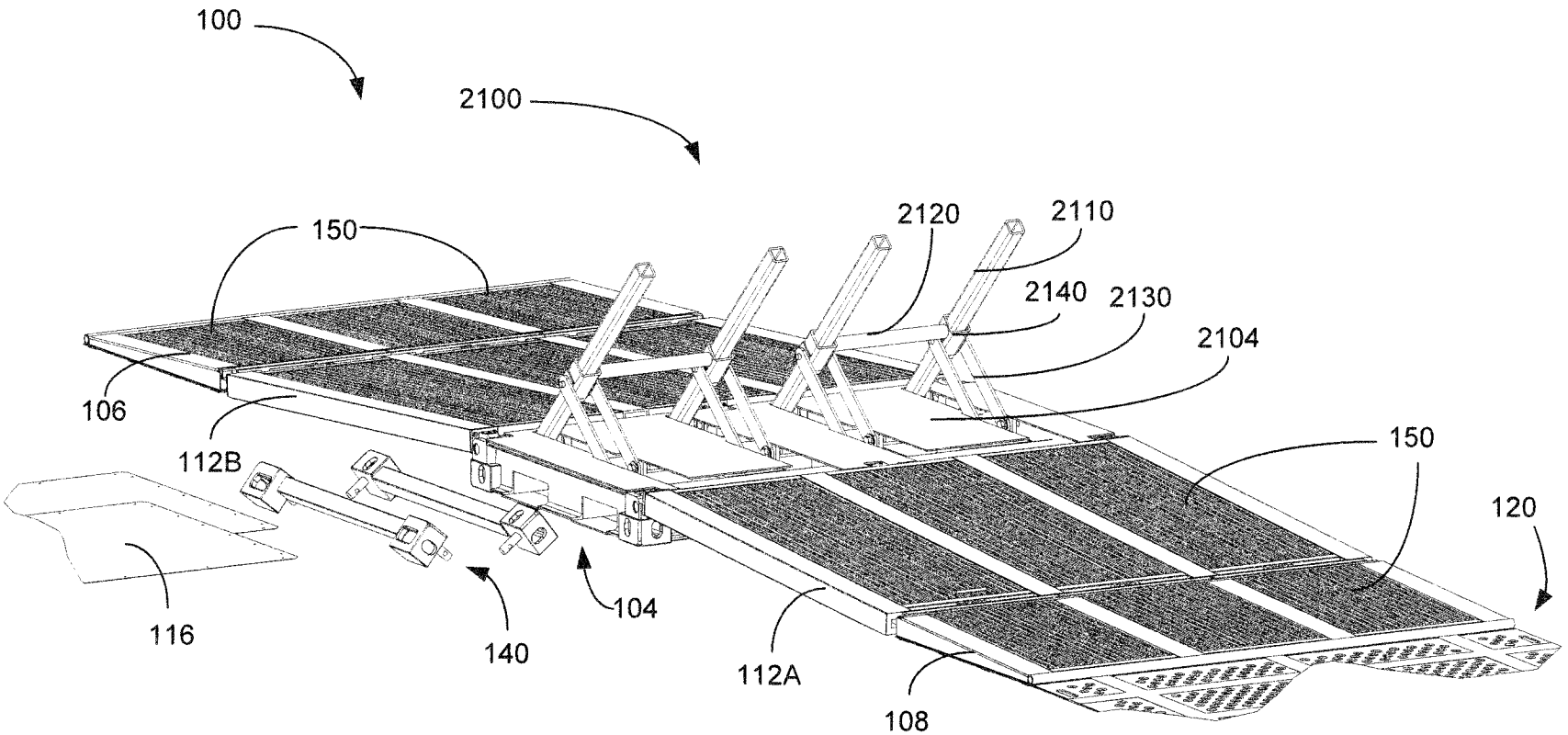
FIG. 21 is a perspective view of the traffic entry regulator unit of FIG. 1 in an unfolded position showing a vertical barrier component deployed in an active barrier position according to an embodiment.

FIG. 21 is a perspective view of the traffic entry regulator unit 100 of FIG. 1 in an unfolded position showing a vertical barrier component 2100 deployed in an active barrier position according to an embodiment. In the passive or hidden position (FIG. 18), the vertical barrier component 2100 is a pre-kitted wedge barrier integrated into the QuadCon size ISO footprint and hidden below the upper plate 2104 of the base 104. In the active barrier position, the active barrier wedge of the vertical barrier component 2100 includes a plurality of pivoting bars 2110 connected by slide bars 2120 which are connected to a plurality of pivoting supports 2130. Each slide bar 2120 is slidably coupled to a pair of adjacent pivoting bars 2110 via a corresponding pair of slide brackets 2140 that are each rotatably coupled to a corresponding pair of pivoting supports 2130. The vertical barrier component 2100 is disposed on top of the base 104 and elevated above the ground by about 9".

Figure 22:
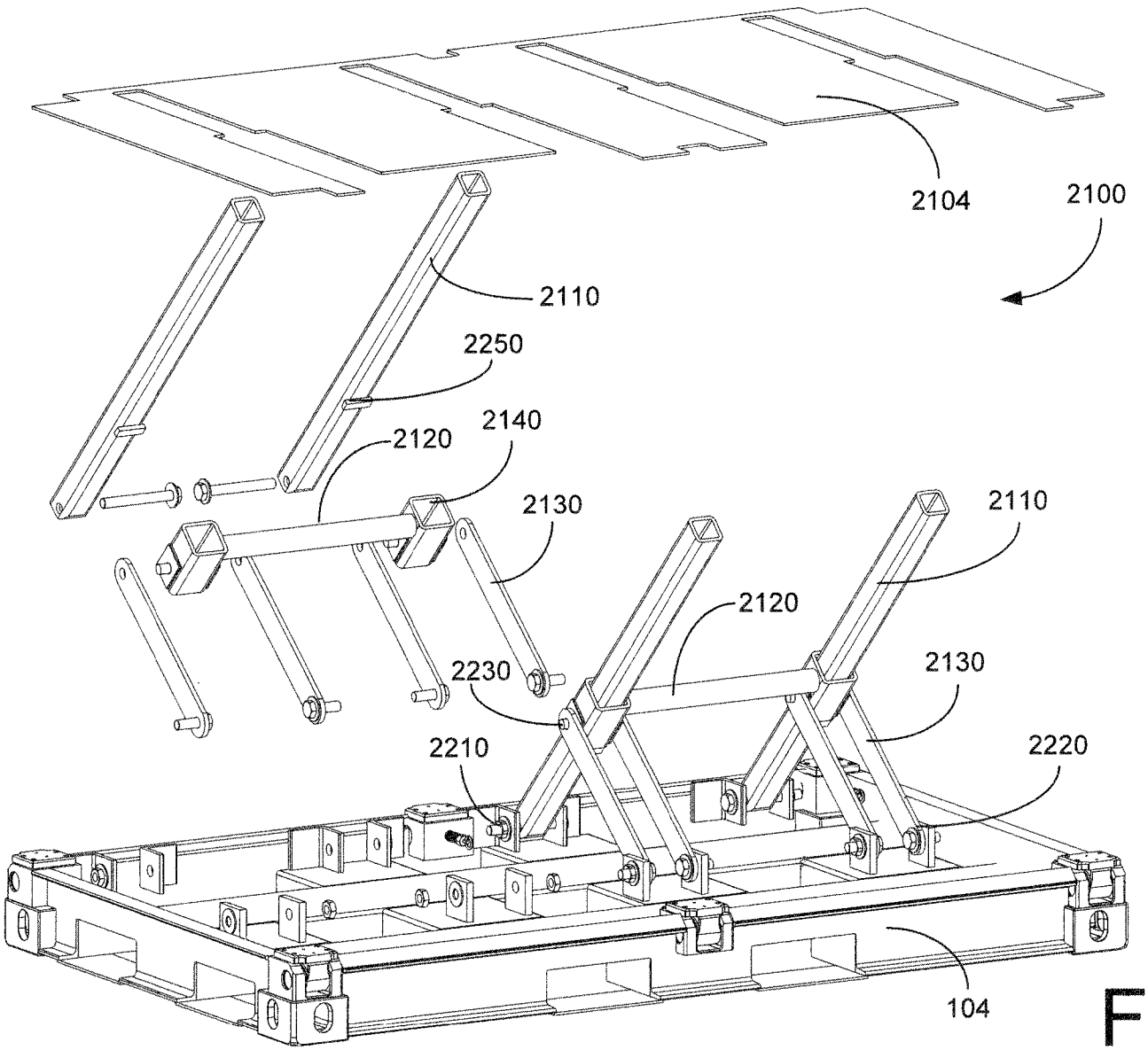
FIG. 22 is an exploded view of the vertical barrier component in the active barrier position.

FIG. 22 is an exploded view of the vertical barrier component 2100 in the active barrier position. Four pivoting bars 2110 have proximal ends that pivot from the base 104 at a first pivot line 2210 disposed horizontally and transversely across the base 104, to move between the passive barrier position hidden in the base 104 and the active barrier position at an angle of about 40-60 degrees with distal ends facing the approaching vehicle upstream. Each pair of adjacent pivoting bars 2110 are slidably connected by one slide bar 2120 disposed generally horizontally and transversely across the pivoting bars 2110. Each slide bar 2120 is slidably coupled to the pair of adjacent pivoting bars 2110 via the corresponding pair of slide brackets 2140 that slide between the proximal ends and distal ends of the pivoting bars 2110 and that are each rotatably coupled to distal ends of the corresponding pair of pivoting supports 2130. As such, each pivoting bar 2110 is connected, via the corresponding slide bracket 2140, to a pair of pivoting supports 2130 having proximal ends that pivot from the base at a second pivot line 2220 disposed horizontally and transversely across the base 104 and upstream from the first pivot line 2210.

To move from the passive barrier position to the active barrier position, the slide bars 2120 are pulled upward away from the base 104, which causes the pivoting bars 2110 to pivot upward from the base 104 around the first pivot line 2210 and the pivoting supports 2130 to pivot upward from the base 104 around the second pivot line 2220, as the slide bars 2120 slide along the pivoting bars 2110 approximately ¼ to ½ of the way along the length of the pivoting bars 2110 to a locked position. Any suitable locking mechanism may be used to lock the slide brackets 2140 in the locked position. For reference, the slide brackets 2140 travel "over center" and hold themselves locked until the slide bar 2120 is picked back upward along the length of the pivoting bars 2110. For example, locking tabs 2250 may be provided on the pivot bars 2110 to engage the slide brackets 2140 in the locked position. The locking tabs 2250 may be spring-loaded. The slide bars 2120 form, via the rotational connection at the slide brackets 2140, a third pivot line 2230 disposed horizontally, transversely, and slidably along the pivoting bars 2110. The pivoting bars 2110, pivoting supports 2120, and slide bars 2130 form the active wedge barrier in the active barrier position. To move the vertical barrier component 2100 back to the passive barrier position, the locking mechanism is unlocked and the pivoting bars 2110, slide bars 2120, and pivoting supports 2130 are pushed back into the base 104 by pivoting relative to the first pivot line 2210, second pivot line 2220, and third pivot line 2230.

Figure 23:
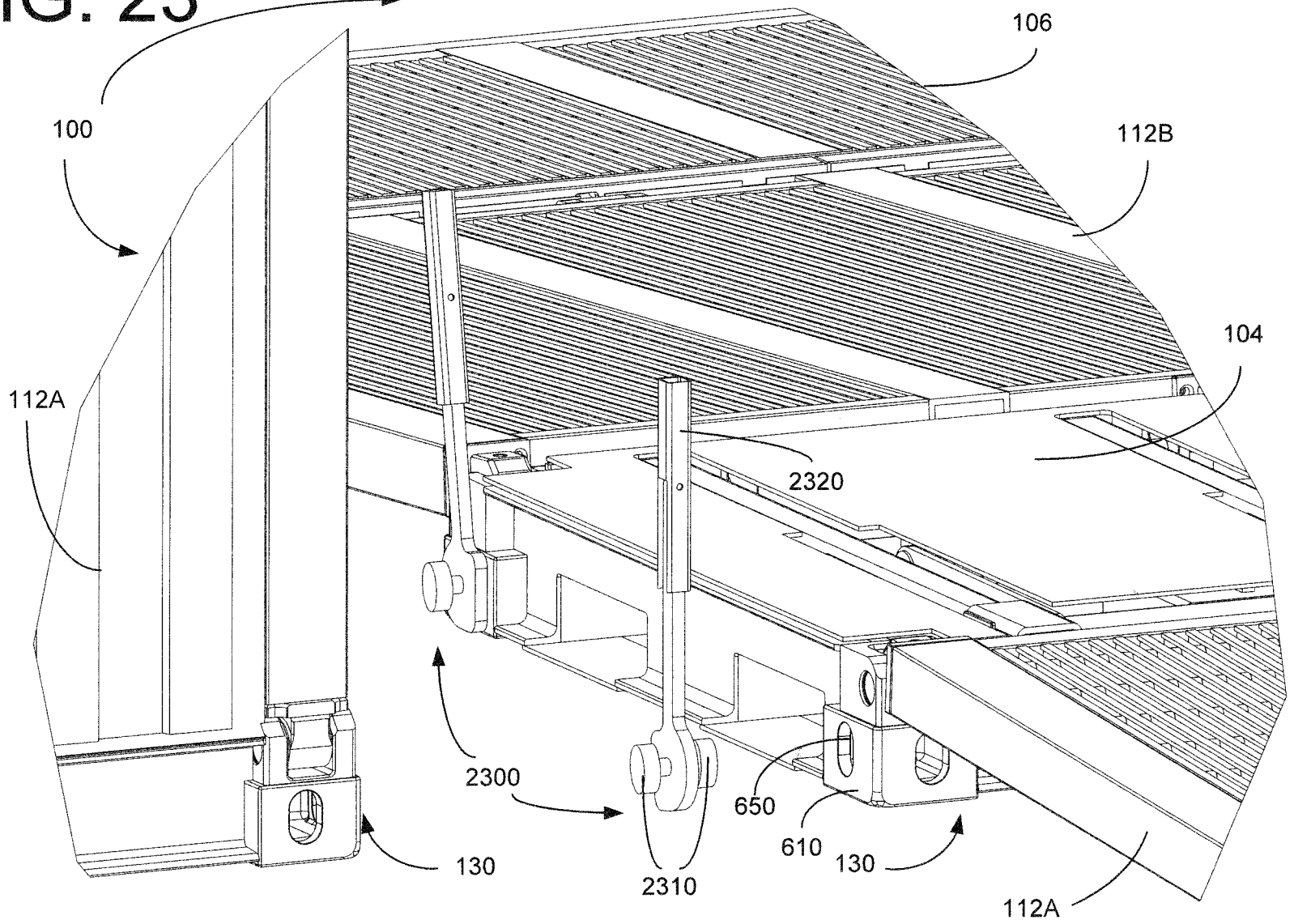
FIG. 23 is an exploded view of a pair of traffic entry regulator units showing a pair of connection tools for modularly connecting the units to form a double traffic entry regulator unit having twice the width.

FIG. 23 is an exploded view of a pair of traffic entry regulator units 100 showing a pair of connection tools 2300 for modularly connecting the units to form a double traffic entry regulator unit having twice the width. One tool is for connecting the entry side base corner member 130 and the other tool is for connecting the exit side base corner member 130. Each tool 2300 includes a pair of oppositely facing elliptical members that are elliptical connection disks 2310 oriented in an axial direction along a connection tool axis that is parallel to the hinge rotation direction of the entry side wall 112A relative to the base 103, which is parallel to the proximal edge of the entry side wall 112A. A connection tool handle 2320 is provided to rotate the elliptical connection disks 2310 around the connection tool axis. The tool handle 2320 is initially oriented generally vertically. The major axis of each elliptical connection disk is oriented along the direction of the handle 2320. The oppositely facing elliptical connection disks 2310 enter oppositely facing, elliptical or elongated side openings 650 of the hollow corner blocks 610 of the adjacent traffic entry regulators 100. The elongated connection disks 2310 are extended outwardly each via a narrow region which allows the connection tool handle 2320 to turn once the elongated connection disks 2310 are inside the respective hollow base corner blocks 610. The elongated connection disks 2310 are rotated downward by the handle 2320 about the elongated side openings 650, to engage and lock into the two adjacent corner blocks 610, respectively, of the two adjacent traffic entry regulators 100.

A more detailed description of operating the connection tools 2300 is provided here. The first traffic entry regulator unit 100 is folded out. Two connection tools 2300 are placed into the entry and exit corner ISO blocks 610 of the entry and exit corner members 130, respectively, with the handles 2320 in vertical position. A second traffic entry regulator unit 100 (still in folded form) is aligned and pushed to a location where its neighboring entry and exit corner ISO blocks 610 of the entry and exit corner members 130 are engaged by the in-place connection tools 2300 and then the second traffic entry regulator unit 100 is moved toward the first unit 100 until all available clearance is removed. Each connection tool 2300 has both elliptical disks on opposite sides engaged into two adjacent corner blocks 610 via the elliptical or elongated side openings 650 on the two adjacent traffic entry regulator units 100. The two connection tools 2300 are rotated downward and outward relative to the base 104 and allowed to rest on the ground. The connection tool handle 2320 is rotated 90 degrees into the horizontal position as a locking mechanism to prevent the tool from rotating off of the ground and allowing units to disengage from each other, by virtue of the elliptical or elongated connection disks 2310 and the elliptical or elongated side openings 650. The second traffic entry regulator is then unfolded. The horizontal positions of the handles 2320 underneath deployed walls/ramps prevent the tools 2300 from being disengaged due to vehicle impact (FIG. 24).

Figure 24:
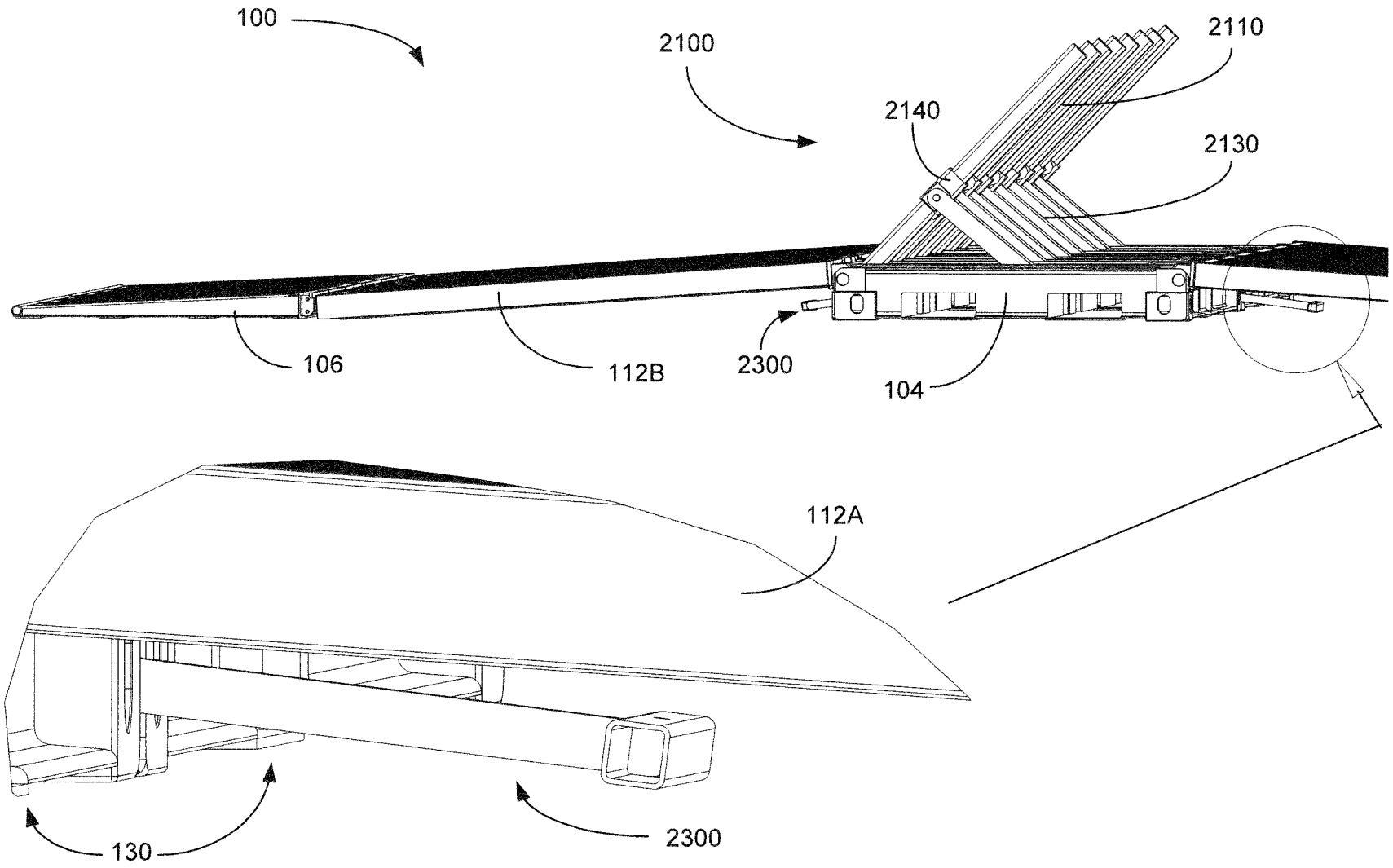
FIG. 24 is a perspective view of the pair of traffic entry regulator units of FIG. 23 connected by the pair of connection tools.

FIG. 24 is a perspective view of the pair of traffic entry regulator units 100 of FIG. 23 connected by the pair of connection tools 2300. The tool handle 2320 on the vehicle entry side is rotated around the connection tool axis from the generally vertical position of FIG. 23 to a generally horizontal position facing approaching vehicles. The tool handle 2320 on the vehicle exit side is rotated around the connection tool axis from the generally vertical position of FIG. 23 to a generally horizontal position facing opposite approaching vehicles.

Figure 25:
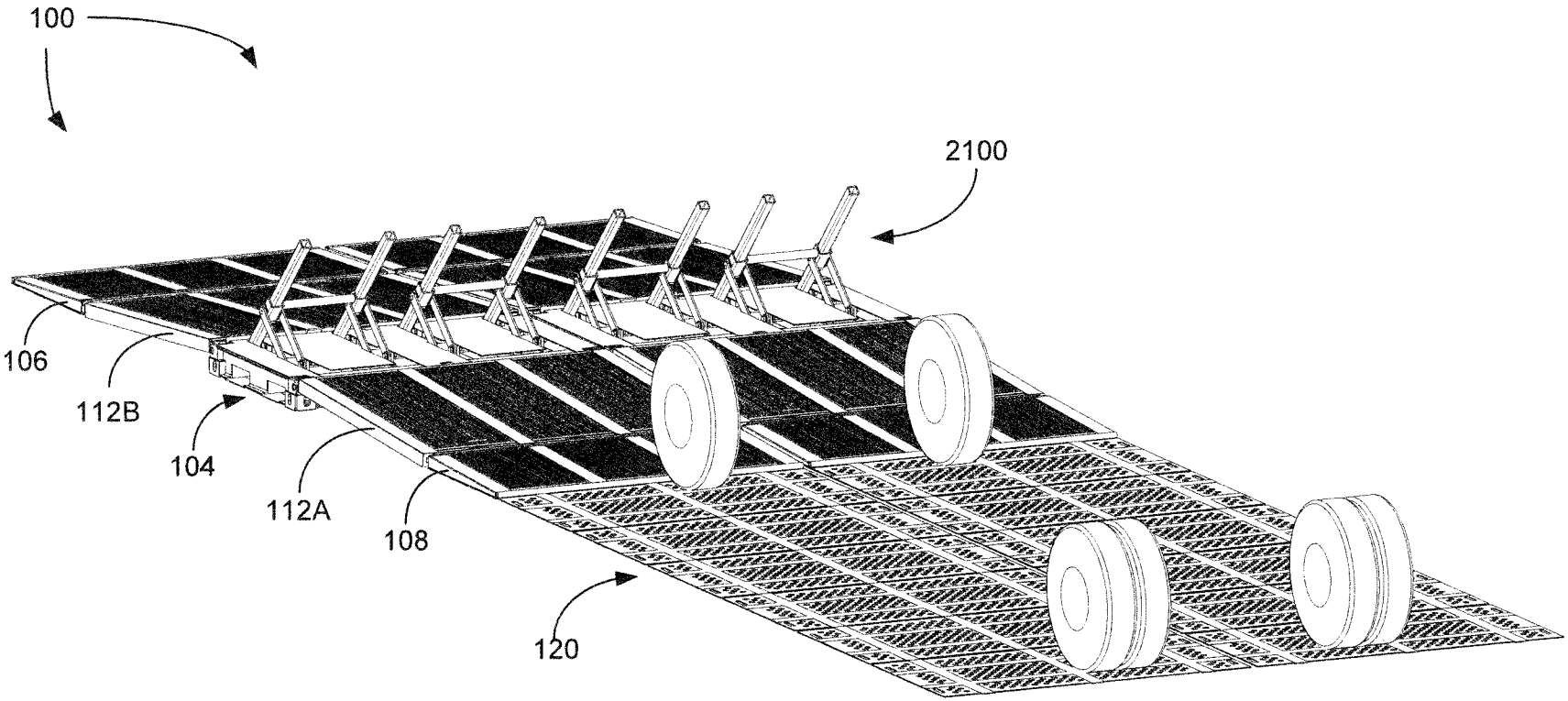
FIG. 25 is another perspective view of the pair of traffic entry regulator units 100 of FIG. 23 connected to accommodate a large vehicle.

FIG. 25 is another perspective view of the pair of traffic entry regulator units 100 of FIG. 23 connected to accommodate a large vehicle. The pair of traffic entry regulator units 100 are combined to provide a total width of about 16' to accommodate box truck class vehicles and other larger class vehicles such as a representative Class 6 vehicle having a wheel-base spacing of 22.5' and a track width of up to 102" or a C7 truck. Four wheels are shown to illustrate a reference size of such vehicles. Due to the modular construction, additional traffic entry regulators 100 can be connected to form a combined unit having three or more multiple times of the width of a single unit.

As will be appreciated by one of ordinary skill in the art, the present invention may be embodied as an apparatus (including, for example, a system, a machine, a device, and/or the like), as a method (including, for example, a business process, and/or the like), or as any combination of the foregoing.

Embodiments of the invention can be manifest in the form of methods and apparatuses for practicing those methods.

Unless explicitly stated otherwise, each numerical value and range should be interpreted as being approximate as if the word "about" or "approximately" preceded the value or range.

Unless otherwise indicated, all numbers expressing quantities of ingredients, properties such as molecular weight, percent, ratio, reaction conditions, and so forth used in the specification and claims are to be understood as being modified in all instances by the term "about," whether or not the term "about" is present. Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

It will be further understood that various changes in the details, materials, and arrangements of the parts which have been described and illustrated in order to explain embodiments of this invention may be made by those skilled in the art without departing from embodiments of the invention encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

All documents mentioned herein are hereby incorporated by reference in their entirety or alternatively to provide the disclosure for which they were specifically relied upon.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. A deployable barrier container apparatus comprising:

in a folded position, a base, a first side wall having a first proximal edge and a first distal edge, a second side wall having a second proximal edge and a second distal edge, the first proximal edge and the second proximal edge rotatably connected to the base on opposite sides of the base, a ceiling top having a distal ceiling top edge and a proximal ceiling top edge which is rotatably connected to the second distal edge of the second side wall, and a stowed top which is stowed inside in the folded position, the stowed top having a proximal stowed top edge rotatably connected to the first distal edge of the first side wall and having a distal stowed top edge, the base, first and second side walls, and the ceiling top forming a rectangular shape as a container in the folded position;

a vertical barrier component connected to the base and disposed inside the container in the folded position of the container; and a horizontal barrier component rotatably connected with the distal stowed top edge of the stowed top and disposed inside the container in the folded position of the container;

in an unfolded position of the container, the vertical barrier component being deployable on the base placed on a ground to oppose vehicle traffic approaching from an upstream side, the second side wall and the ceiling top being disposed on the downstream side of the base, the first side wall and the stowed top being disposed on the upstream side of the base and on which approaching vehicles move, the horizontal barrier component being disposed upstream of the stowed top and on which the approaching vehicles move, the horizontal barrier component comprising an elongated sliding friction mat which creates a sliding friction interface with the ground upon contact of a moving vehicle with the deployed vertical barrier component in the deployed position.

2. The deployable barrier container apparatus of claim 1, further comprising:

a pair of top corner crossbars which, in the folded position of the container, are disposed on opposite sides of the ceiling top between the first side wall and the second side wall, releasably connecting opposite top corners of the first side wall and the second side wall.

3. The deployable barrier container apparatus of claim 1, wherein, in the unfolded position of the container, the base is elevated above the ground, the second side wall on the upstream side forming an up-ramp to the base, the first side wall on the downstream side forming a down-ramp from the base.

4. The deployable barrier container apparatus of claim 3, wherein the first side wall includes a plurality of spaced-apart longitudinal beams oriented parallel to a direction of vehicle traffic interconnected by a plurality of spaced-apart lateral beams to provide pockets to receive grate decking units disposed on an upper side of the down-ramp, in the unfolded position of the container, on which the approaching vehicles move; and wherein the second side wall includes a plurality of spaced-apart longitudinal beams oriented parallel to the direction of vehicle traffic interconnected by a plurality of spaced-apart lateral beams to provide pockets to receive grate decking units disposed on an upper side of the up-ramp, in the unfolded position of the container, on which the approaching vehicles move.

5. The deployable barrier container apparatus of claim 4, wherein the stowed top decreases in thickness from the proximal stowed top edge to the distal stowed top edge to form a down-toe-ramp, the stowed top including a plurality of spaced-apart longitudinal beams oriented parallel to the direction of vehicle traffic interconnected by a plurality of spaced-apart lateral beams to provide pockets to receive grate decking units disposed on an upper side of the down-toe-ramp, in the unfolded position of the container, on which the approaching vehicles move; and wherein the ceiling top decreases in thickness from the proximal ceiling top edge to the distal ceiling top edge to form an up-toe-ramp, the ceiling top including a plurality of spaced-apart longitudinal beams oriented parallel to the direction of vehicle traffic interconnected by a plurality of spaced-apart lateral beams to provide pockets to receive grate decking units disposed on an upper side of the up-toe-ramp, in the unfolded position of the container, on which the approaching vehicles move.

6. The deployable barrier container apparatus of claim 1, wherein the sliding friction mat of the horizontal barrier component comprises a plurality of sliding friction mat sections connected in series, the plurality of sliding friction mat sections being collapsed and stored inside the container in the folded position of the container and being extended to form the elongated sliding friction mat on the ground in the unfolded position of the container.

7. The deployable barrier container apparatus of claim 1, wherein the vertical barrier component is movable between an active barrier position and a passive barrier position, the vertical barrier component being housed inside the base in the passive barrier position, the vertical barrier component being deployed above the base in the active barrier position.

8. The deployable barrier container apparatus of claim 1, wherein the vertical barrier component comprises a plurality of pivoting bars having proximal ends connected to the base to pivot around a first pivot line, a plurality of pivoting supports having proximal ends connected to the base to pivot around a second pivot line disposed upstream of the first pivot line, and one or more slide bars each transversely coupled to at least two of the pivoting bars to slide along the pivoting bars between the proximal ends and distal ends of the pivoting bars, the one or more slide bars being connected to distal ends of the pivoting supports to pivot around the second pivot line, the distal ends of the pivoting bars pointing at an angle upward in the upstream direction against approaching vehicles in the active barrier position.

9. The deployable barrier container apparatus of claim 1, further comprising:

four base corner members disposed at four corners of the base under the corresponding first side wall or corresponding second side wall, each base corner member includes a hollow base corner block having an elongated side opening facing outwardly in a direction parallel to the bottom edges of the side walls; and a pair of connection tools to modularly connect two bases of two deployable barrier container apparatuses side-by-side by connecting two hollow base corner blocks of a first base of a first deployable barrier container apparatus and two hollow base corner blocks of a second base of a second deployable barrier container apparatus, each connection tool including a pair of oppositely facing elongated connection disks oriented in an axial direction along a connection tool axis that is parallel to the bottom edges of the side walls, the elongated connection disks being shaped and sized to fit through the elongated side openings of the hollow base corner blocks into the hollow base corner blocks and each being extended outwardly via a narrow region which allows the connection tool to rotate with a connection tool handle from a generally vertical position to a generally horizontal position to engage and lock the elongated connection disks against the elongated side openings in the generally horizontal position of the connection tool.

10. A deployable barrier container apparatus comprising:

in a folded position, a base, a first side wall having a first proximal edge and a first distal edge, a second side wall having a second proximal edge and a second distal edge, the first proximal edge and the second proximal edge rotatably connected to the base on opposite sides of the base, a ceiling top having a distal ceiling top edge and a proximal ceiling top edge which is rotatably connected to the second distal edge of the second side wall, and a stowed top which is stowed inside in the folded position, the stowed top having a proximal stowed top edge rotatably connected to the first distal edge of the first side wall and having a distal stowed top edge, the base, first and second side walls, and the ceiling top forming a rectangular shape as a container in the folded position;

a vertical barrier component connected to the base and disposed inside the container in the folded position of the container, the vertical barrier component being deployable on the base placed on a ground to oppose vehicle traffic approaching from an upstream side; and sliding friction means for creating a sliding friction interface with the ground upon contact of an approaching vehicle with the deployed vertical barrier component, to prevent contact between the approaching vehicle and the ground, the sliding friction means being connected with the first side wall and disposed inside the container in the folded position of the container;

in an unfolded position of the container, the second side wall and the ceiling top being disposed on the downstream side of the base, the first side wall and the stowed top being disposed on the upstream side of the base and on which approaching vehicles move, the sliding friction means being disposed upstream of the stowed top and on which the approaching vehicles move.

11. The deployable barrier container apparatus of claim 10, wherein, in the unfolded position of the container, the base is elevated above the ground, the second side wall on the upstream side forming an up-ramp to the base, the first side wall on the downstream side forming a down-ramp from the base.

12. The deployable barrier container apparatus of claim 11, wherein the first side wall includes a plurality of spaced-apart beams and first load-distributing means for distributing load over the spaced-apart beams, the first load-distributing means being disposed, in the unfolded position of the container, on which the approaching vehicles move; and wherein the second side wall includes a plurality of spaced-apart beams and second load-distributing means for distributing load over the spaced-apart beams, the second load-distributing means being disposed, in the unfolded position of the container, on which the approaching vehicles move.

13. The deployable barrier container apparatus of claim 10, wherein the stowed top decreases in thickness from the proximal stowed top edge to the distal stowed top edge to form a down-toe-ramp, the stowed top including a plurality of spaced-apart beams and third load-distributing means for distributing load over the spaced-apart beams, the third load-distributing means being disposed, in the unfolded position of the container, on which the approaching vehicles move; and wherein the ceiling top decreases in thickness from the proximal ceiling top edge to the distal ceiling top edge to form an up-toe-ramp, the ceiling top including a plurality of spaced-apart beams and fourth load-distributing means for distributing load over the spaced-apart beams, the fourth load-distributing means being disposed, in the unfolded position of the container, on which the approaching vehicles move.

14. The deployable barrier container apparatus of claim 10, wherein the vertical barrier component comprises:

a plurality of pivoting bars having proximal ends connected to the base to pivot around a first pivot line and distal ends pointing at an angle upward in the upstream direction against approaching vehicles in an active barrier position; and means for collapsing the pivoting bars to be housed inside the base in a passive barrier position and deploying the pivoting bars to be supported at the angle upward in the upstream direction against approaching vehicles in the active barrier position.

15. The deployable barrier container apparatus of claim 10, further comprising:

means for detachably connecting adjacent containers that are placed side-by-side and, in the unfolded position of the containers, provide adjacent side-by-side vertical barriers against approaching vehicles.

16. A deployable barrier container apparatus comprising:

in a folded position, a base, a first side wall having a first proximal edge and a first distal edge, a second side wall having a second proximal edge and a second distal edge, the first proximal edge and the second proximal edge rotatably connected to the base on opposite sides of the base, a ceiling top having a distal ceiling top edge and a proximal ceiling top edge which is rotatably connected to the second distal edge of the second side wall, and a stowed top which is stowed inside in the folded position, the stowed top having a proximal stowed top edge rotatably connected to the first distal edge of the first side wall and having a distal stowed top edge, the base, first and second side walls, and the ceiling top forming a rectangular shape as a container in the folded position; and a vertical barrier component connected to the base and disposed inside the container in the folded position of the container;

in an unfolded position of the container, the vertical barrier component being deployable on the base placed on a ground to oppose vehicle traffic approaching from an upstream side, the second side wall and the ceiling top being disposed on the downstream side of the base, the first side wall and the stowed top being disposed on the upstream side of the base and on which approaching vehicles move, the base being elevated above the ground, the second side wall on the upstream side forming an up-ramp to the base, the first side wall on the downstream side forming a down-ramp from the base.

17. The deployable barrier container apparatus of claim 16, further comprising:

a horizontal barrier component connected with the connector panel and disposed inside the container in the folded position of the container, the horizontal barrier component being disposed upstream of the first side wall and the stowed top, and on which the approaching vehicles move, the horizontal barrier component comprising an elongated sliding friction mat which creates a sliding friction interface with the ground upon contact of a moving vehicle with the deployed vertical barrier component;

wherein the sliding friction mat of the horizontal barrier component comprises a plurality of sliding friction mat sections connected in series, the plurality of sliding friction mat sections being collapsed and stored inside the container in the folded position of the container and being extended to form the elongated sliding friction mat on the ground in the unfolded position of the container.

18. The deployable barrier container apparatus of claim 16, wherein the first side wall includes a plurality of spaced-apart longitudinal beams oriented parallel to a direction of vehicle traffic interconnected by a plurality of spaced-apart lateral beams to provide pockets to receive grate decking units disposed on an upper side of the down-ramp, in the unfolded position of the container, on which the approaching vehicles move; and wherein the second side wall includes a plurality of spaced-apart longitudinal beams oriented parallel to the direction of vehicle traffic interconnected by a plurality of spaced-apart lateral beams to provide pockets to receive grate decking units disposed on an upper side of the up-ramp, in the unfolded position of the container, on which the approaching vehicles move.

19. The deployable barrier container apparatus of claim 16, wherein the vertical barrier component is movable between an active barrier position and a passive barrier position, the vertical barrier component being housed inside the base in the passive barrier position, the vertical barrier component being deployed above the base in the active barrier position; and wherein the vertical barrier component comprises a plurality of pivoting bars having proximal ends connected to the base to pivot around a first pivot line, a plurality of pivoting supports having proximal ends connected to the base to pivot around a second pivot line disposed upstream of the first pivot line, and one or more slide bars each transversely coupled to at least two of the pivoting bars to slide along the pivoting bars between the proximal ends and distal ends of the pivoting bars, the one or more slide bars being connected to distal ends of the pivoting supports to pivot around the second pivot line, the distal ends of the pivoting bars pointing at an angle upward in the upstream direction against approaching vehicles in the active barrier position.

20. The deployable barrier container apparatus of claim 16, further comprising:

four base corner members disposed at four corners of the base under the corresponding first side wall or corresponding second side wall, each base corner member includes a hollow base corner block having an elongated side opening facing outwardly in a direction parallel to the bottom edges of the side walls; and a pair of connection tools to modularly connect two bases of two deployable barrier container apparatuses side-by-side by connecting two hollow base corner blocks of a first base of a first deployable barrier container apparatus and two hollow base corner blocks of a second base of a second deployable barrier container apparatus, each connection tool including a pair of oppositely facing elongated connection disks oriented in an axial direction along a connection tool axis that is parallel to the bottom edges of the side walls, the elongated connection disks being shaped and sized to fit through the elongated side openings of the hollow base corner blocks into the hollow base corner blocks and each being extended outwardly via a narrow region which allows the connection tool to rotate with a connection tool handle from a generally vertical position to a generally horizontal position to engage and lock the elongated connection disks against the elongated side openings in the generally horizontal position of the connection tool.

* * * * *